US011557858B2

(12) United States Patent
Hetrick et al.

(10) Patent No.: US 11,557,858 B2
(45) Date of Patent: Jan. 17, 2023

(54) SPRING CLIP AND CONNECTOR FOR A FLAT FLEXIBLE CABLE

(71) Applicant: TE Connectivity Services GmbH, Schaffhausen (CH)

(72) Inventors: Ryan David Hetrick, Middletown, PA (US); John Mark Myer, Middletown, PA (US); Christopher Raybold, Middletown, PA (US)

(73) Assignee: TE Connectivity Solutions GmbH

( * ) Notice: Subject to any disclaimer, the term of this patent is extended or adjusted under 35 U.S.C. 154(b) by 8 days.

(21) Appl. No.: 17/232,252

(22) Filed: Apr. 16, 2021

(65) Prior Publication Data

US 2022/0337001 A1 Oct. 20, 2022

(51) Int. Cl.

| | |
|---|---|
| ***H01R 13/15*** | (2006.01) |
| ***H01R 13/635*** | (2006.01) |
| ***H01R 13/639*** | (2006.01) |
| ***H01R 13/627*** | (2006.01) |
| ***H01R 12/79*** | (2011.01) |

(52) U.S. Cl.

CPC ..... *H01R 13/635* (2013.01); *H01R 12/79* (2013.01); *H01R 13/6275* (2013.01); *H01R 13/639* (2013.01)

(58) Field of Classification Search

CPC ..... H01R 13/635; H01R 12/78; H01R 12/88

See application file for complete search history.

(56) References Cited

U.S. PATENT DOCUMENTS 3,701,071 A * 10/1972 Landman ..... H01R 12/714 439/71
3,728,473 A * 4/1973 Kuo ..... H01R 4/2495 174/94 R
3,880,488 A * 4/1975 Collier ..... H01R 12/68 439/410
3,989,336 A * 11/1976 Rizzio, Jr. ..... H01R 12/62 439/456
4,413,872 A * 11/1983 Rudy, Jr. ..... H01R 4/2462 439/387
4,455,057 A * 6/1984 Mariani ..... H01R 4/2425 174/84 C
4,483,578 A * 11/1984 Masahiro ..... H01R 12/88 439/325
4,647,131 A * 3/1987 Van Woensel ..... H01R 12/774 439/456
4,832,620 A 5/1989 Yamamoto
5,860,832 A * 1/1999 Wayt ..... H01R 12/775 439/465
6,068,505 A 5/2000 Sai
(Continued)

OTHER PUBLICATIONS

International Search Report, Application No. IB2022/053623, Filing Date Apr. 18, 2022.

*Primary Examiner* — Neil Abrams

(57) ABSTRACT

A spring clip includes a first beam and a second beam connected to the first beam and resiliently deflectable toward the first beam from a relaxed position distal from the first beam to a compressed position proximal to the first beam. The second beam has a spring latch extending toward the first beam. The spring latch engages the first beam to secure the second beam in the compressed position. The clip may be positioned in a housing having a rotatable cover formed to compress the clip against a conductor when moved to a closed position.

30 Claims, 18 Drawing Sheets

(56) References Cited

U.S. PATENT DOCUMENTS

| | | | | |
|---|---|---|---|---|
| 6,099,366 | A * | 8/2000 | Shinchi | H01R 43/0207 439/594 |
| 6,305,968 | B1 | 10/2001 | Hio et al. | |
| 6,332,801 | B1 * | 12/2001 | Watanbe | H01R 4/2433 439/495 |
| 6,375,492 | B1 | 4/2002 | Hio | |
| 6,568,955 | B2 * | 5/2003 | Hotea | H01R 12/79 439/495 |
| 6,712,649 | B2 * | 3/2004 | Mano | H01R 24/20 439/441 |
| 6,746,269 | B1 * | 6/2004 | Casses | H01R 4/2495 439/422 |
| 6,821,158 | B2 * | 11/2004 | Iida | H01R 12/79 439/492 |
| 7,534,130 | B2 * | 5/2009 | Tanaka | H01R 12/79 439/495 |
| 8,398,443 | B2 * | 3/2013 | Groll | G01N 27/3273 439/862 |
| 9,166,319 | B2 * | 10/2015 | Gingrich, III | H01R 12/771 |
| 2021/0408712 | A1 * | 12/2021 | Myer | H01R 13/426 |

* cited by examiner

SPRING CLIP AND CONNECTOR FOR A FLAT FLEXIBLE CABLE

FIELD OF THE INVENTION

The present invention relates to a connector and, more particularly, to a connector having a spring clip for connection to a flat flexible cable.

BACKGROUND

Flat flexible cables (FFCs) or flat flexible circuits are electrical components consisting of at least one conductor (e.g., a metallic foil conductor) embedded within a thin, flexible strip of insulation. Flat flexible cables are gaining popularity across many industries due to advantages offered over their traditional "round wire" counter parts. Specifically, in addition to having a lower profile and lighter weight, FFCs enable the implementation of large circuit pathways with significantly greater ease compared to round wire-based architectures. As a result, FFCs are being considered for many complex and/or high-volume applications, including wiring harnesses, such as those used in automotive manufacturing.

The implementation or integration of FFCs into existing wiring environments is not without significant challenges. In an automotive application, by way of example only, an FFC-based wiring harness would be required to mate with perhaps hundreds of existing components, including sub-harnesses and various electronic devices (e.g., lights, sensors, etc.), each having established, and in some cases standardized, connector or interface types. Accordingly, a critical obstacle preventing the implementation of FFCs into these applications includes the need to develop quick, robust, and low resistance termination techniques which enable an FFC to be connectorized for mating with these existing connections.

Current FFC terminals include piercing-style crimp terminals, wherein sharpened tines of a terminal are used to pierce the insulation of the FFC in order to attempt to establish a secure electrical connection with the embedded conductor. In harsh environmental conditions, however, such a connection suffers from plastic creep and stress relaxation over time, failing to reliably maintain the electrical connection between the terminal and the conductor.

SUMMARY

A spring clip includes a first beam and a second beam connected to the first beam and resiliently deflectable toward the first beam from a relaxed position distal from the first beam to a compressed position proximal to the first beam. The second beam has a spring latch extending toward the first beam. The spring latch engages the first beam to secure the second beam in the compressed position.

BRIEF DESCRIPTION OF THE DRAWINGS

The invention will now be described by way of example with reference to the accompanying Figures, of which.

DETAILED DESCRIPTION OF THE EMBODIMENTS

Figure 1:
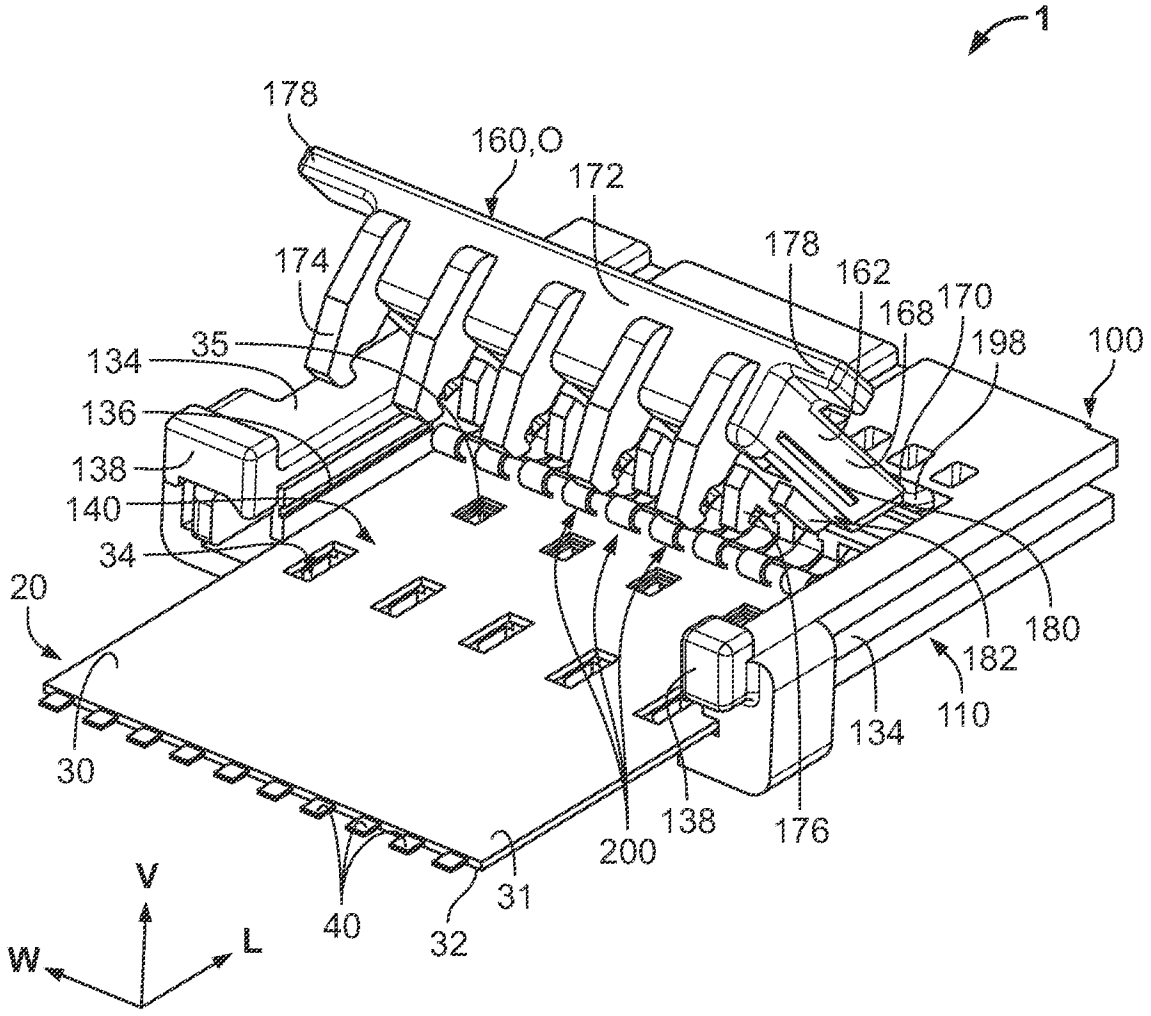
FIG. 1 is a perspective view of a connector assembly according to a first embodiment.

Exemplary embodiments of the present disclosure will be described hereinafter in detail with reference to the attached drawings, wherein like reference numerals refer to like elements. The present disclosure may, however, be embodied in many different forms and should not be construed as being limited to the embodiments set forth herein; rather, these embodiments are provided so that the present disclosure will convey the concept of the disclosure to those skilled in the art. In addition, in the following detailed description, for purposes of explanation, numerous specific details are set forth in order to provide a thorough understanding of the disclosed embodiments. However, it is apparent that one or more embodiments may also be implemented without these specific details.

Throughout the specification, directional descriptors are used such as "longitudinal", "width", and "vertical". These descriptors are merely for clarity of the description and for differentiation of the various directions. These directional descriptors do imply or require any particular orientation of the disclosed elements.

Throughout the drawings, only one of a plurality of identical elements may be labeled in a figure for clarity of the drawings, but the detailed description of the element herein applies equally to each of the identically appearing elements in the figure.

A connector assembly 1 according to a first embodiment will be described with reference to FIGS. 1-7. The connector assembly 1 comprises a housing 100, a plurality of spring clips 200 disposed in the housing 100, and a flat flexible cable (FFC) 20 disposed in the housing 100 and electrically connected to the spring clips 200. One of the spring clips 200 will be referenced and described in detail in the following description, but the description applies equally to each of the spring clips 200 of the connector assembly 1.

Figure 2:
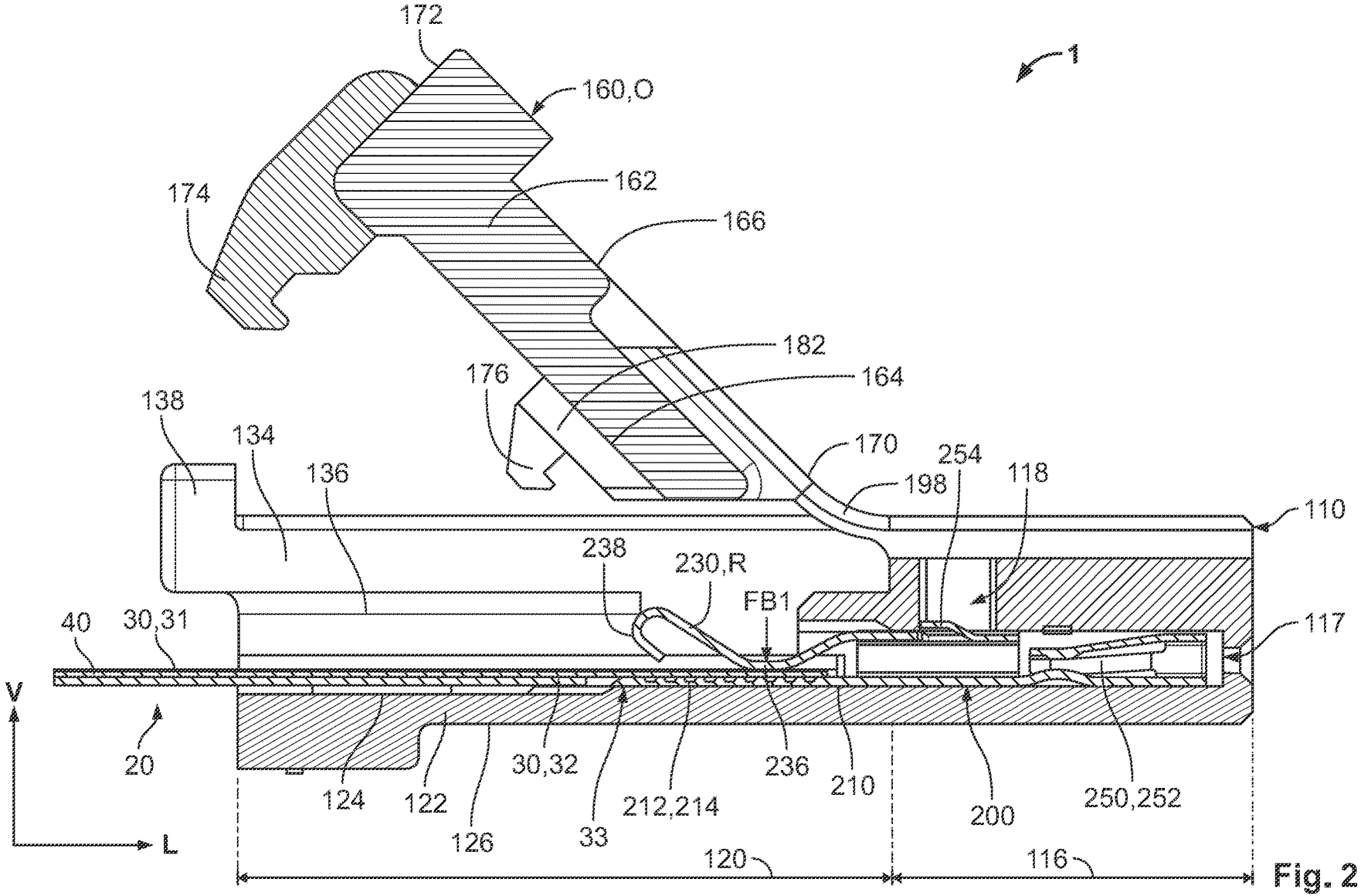
FIG. 2 is a sectional side view of the connector assembly of FIG. 1 with a cover in an open position.
Figure 3:
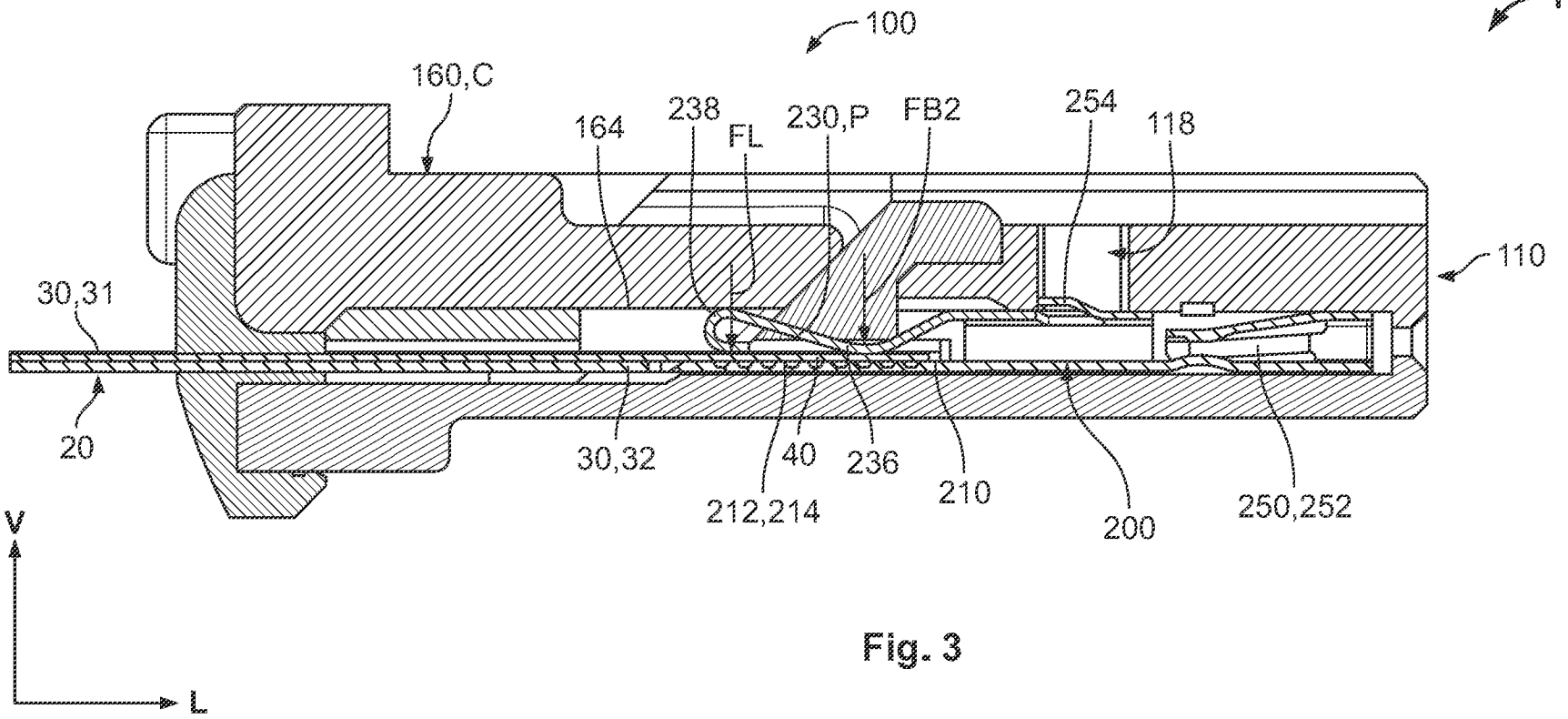
FIG. 3 is a sectional side view of the connector assembly of FIG. 1 with the cover in a closed position.
Figure 4:
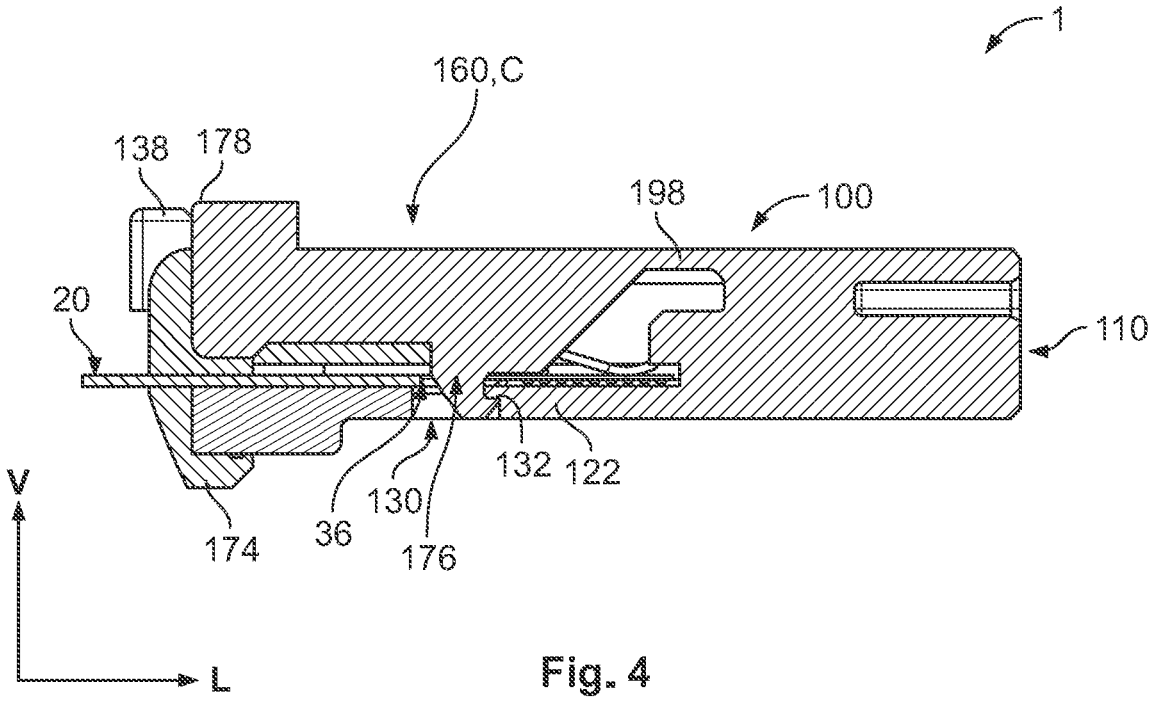
FIG. 4 is another sectional side view of the connector assembly of FIG. 1 with the cover in the closed position.
Figure 5:
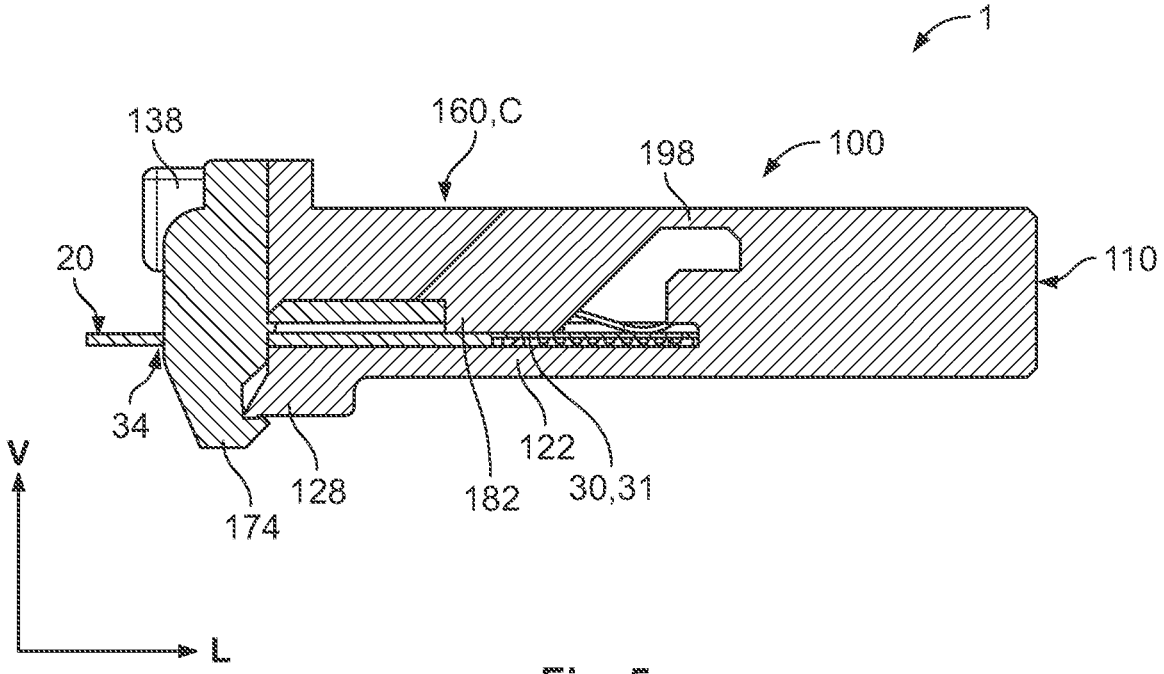
FIG. 5 is another sectional side view of the connector assembly of FIG. 1 with the cover in the closed position.

The housing 100, as shown in FIGS. 1-6, has a base 110 and a cover 160 movable with respect to the base 110 between an open position O, shown in FIGS. 1 and 2, and a closed position C, shown in FIGS. 3-6. In the first embodiment, as shown in FIGS. 2, 4, and 5, the base 110 is attached to the cover 160 by a hinge 198 and the cover 160 is rotatable about the hinge 198 between the open position O and the closed position C. In the shown embodiment, the base 110 and the cover 160 are monolithically formed in a single piece and the hinge 198 is a film hinge. In other embodiments, the base 110 and the cover 160 can be formed in separate pieces and can be attached at the hinge 198 and rotatable about the hinge 198, or the base 110 and the cover 160 can be entirely separate pieces without the hinge 198. The housing 100 is formed of an insulative material, such as a plastic.

The base 110, as shown in FIG. 2, has a closed section 116 and an open section 120 extending from the closed section 116 along a longitudinal direction L. The closed section 116 encloses a receiving passageway 117 extending through the closed section 116 along the longitudinal direction L. A spring latch passageway 118 extends through the closed section 116 in a vertical direction V perpendicular to the longitudinal direction L and communicates with the receiving passageway 117.

The open section 120, as shown in FIGS. 1 and 2, has a bottom wall 122 and a pair of sidewalls 134 extending from the bottom wall 122 in the vertical direction V. The bottom wall 122 and the sidewalls 134 define an interior receiving space 140 in the open section 120.

The bottom wall 122 has an interior surface 124 and an exterior surface 126 opposite the interior surface 124 in the vertical direction V, as shown in FIG. 2. As shown in FIG. 5, the bottom wall 122 has a first catch 128 at an end of the bottom wall 122 in the longitudinal direction L. The first catch 128 protrudes from the bottom wall 122 in the longitudinal direction L and in the vertical direction V. As shown in FIG. 4, a latch passageway 130 extends through the bottom wall 122 in the vertical direction V. The latch passageway 130 forms a second catch 132 in the bottom wall 122.

The sidewalls 134, as shown in FIGS. 1 and 2, each have a groove 136 extending into the sidewall 134 along the longitudinal direction L. Only the groove 136 on one of the sidewalls 134 is visible in FIGS. 1 and 2 but is likewise positioned in a mirror symmetrical manner on the other of the sidewalls 134. Each of the sidewalls 134 has a positioning tab 138 positioned at an end of the sidewall 134 in the longitudinal direction L and extending from the sidewall 134 in the vertical direction V.

The cover 160, as shown in FIGS. 1 and 2, has a main body 162 with a first end 170 and an opposite second end 172. The first end 170 of the main body 162 is attached to the hinge 198 in the shown embodiment. The main body 162 has a pressing surface 164 and an exterior surface 166 opposite the pressing surface 164.

As shown in FIGS. 1 and 2, the cover 160 has a plurality of first latches 174 extending from the pressing surface 164 at the second end 172 of the main body 162. In the shown embodiment, the cover 160 has a plurality of second latches 176 extending from the pressing surface 164 between the first end 170 and the second end 172. The cover 160 has a pair of flanges 178 extending from the second end 172 of the main body 162 in a width direction W perpendicular to the longitudinal direction L and the vertical direction V, and has a plurality of standoffs 182 extending from the pressing surface 164 in a staggered manner with the second latches 176.

Only one of the first latches 174, one of the second latches 176, and one of the standoffs 182 is labeled in FIG. 1 for clarity of the drawings. The description herein of the first latches 174, the second latches 176, and the standoffs 182 applies equally to each of the identically appearing elements FIG. 1. The embodiment shown in FIG. 1 has five first latches 174 distributed along the main body 162 in the width direction W and four second latches 176 distributed along the main body 162 in the width direction W. In other embodiments, the number of first latches 174 and the number of second latches 176 can be any other number of latches 174, 176, including one first latch 174 and one second latch 176.

As shown in FIGS. 1 and 2, the main body 162 has a pair of side surfaces 168 disposed opposite one another, extending between the first end 170 and the second end 172 of the main body 162, and connecting the pressing surface 164 and the exterior surface 166. Each of the side surfaces 168 has a protrusion 180 protruding from the side surface 168 and extending along the longitudinal direction L. Only one of the side surfaces 168 with one protrusion 180 is visible in FIG. 1 but the other side surface 168 with the other protrusion 180 is likewise positioned in a mirror symmetrical manner on the opposite side of the main body 162.

The spring clip 200, as shown in FIGS. 2 and 3, has a first beam 210 and a second beam 230 each connected to and extending from a connection section 250. The spring clip 200 is formed of a conductive material. In an embodiment, the first beam 210, the second beam 230, and the connection section 250 are monolithically formed in a single piece from a conductive material.

The first beam 210, as shown in FIGS. 2 and 3, has a contact surface 212 facing the second beam 230. The contact surface 212 has a textured pattern 214 in the shown embodiment. In an embodiment, the textured pattern 214 is a bidirectional serration. In other embodiments, the textured pattern 214 can be any other type of roughening of the contact surface 212 used in electrical and mechanical contacting, such as contact bumps or ribs.

The second beam 230, as shown in FIG. 3, has a contact bend 236 extending toward the first beam 210 and a friction lock 238 at an end opposite the connection section 250. The friction lock 238 is bent back toward the first beam 210. The second beam 230 is resiliently deflectable toward the first beam 210 from a relaxed position R shown in FIG. 2 to a compressed position P shown in FIG. 3.

The connection section 250, in the embodiment shown in FIGS. 2 and 3, has a pin interface 252 connecting the first beam 210 and the second beam 230. In the shown embodiment, the pin interface 252 is a box and spring interface adapted to resiliently abut and electrically connect to a contact pin. In other embodiments, the pin interface 252 may be any type of interface adapted to electrically connect to a contact pin that is connected to the first beam 210 and the second beam 230 and permits resilient deflection of the second beam 230 toward the first beam 210. The connection section 250 has a latch arm 254 protruding in the vertical direction V. The latch arm 254 is resiliently deflectable toward the connection section 250.

The FFC 20, as shown in FIGS. 1 and 2, includes an insulation material 30 and a plurality of flat conductors 40 embedded in the insulation material 30. In an embodiment, the flat conductors 40 are each a metallic foil, such as a copper foil, by way of example only, patterned in any desirable configuration. The insulation material 30, such as a polymer insulation material, may be applied to either or both sides of the flat conductors 40 via an adhesive material or extruded directly over the flat conductors 40. The flat conductors 40 may also be referred to as conductors 40 herein.

The insulation material 30 has an upper side 31 and a lower side 32 opposite the upper side 31 in the vertical direction V, as shown in FIGS. 1 and 2. The conductors 40 are embedded in the insulation material 30 between the upper side 31 and the lower side 32. The FFC 20, in the embodiment shown in FIG. 2, has a stripped section 33 in which the lower side 32 of the insulation material 30 is removed to expose a side of the conductors 40. In another embodiment, both the lower side 32 and the upper side 31 of the insulation material 30 can be stripped in the stripped section 33.

As shown in the embodiment of FIG. 1, the FFC 20 has a plurality of first latch openings 34 and a plurality of second latch openings 35 extending through the insulation material 30. The first latch openings 34 and the second latch openings 35 are positioned between the conductors 40 and do not expose the conductors 40. In the shown embodiment, the FFC 20 has five first latch openings 34 and four second latch openings 35. In other embodiments, the FFC 20 could have any number of first latch openings 34 and second latch openings 35, provided that the number of first latch openings 34 corresponds to the number of first latches 174 and the number of second latch openings 35 corresponds to the number of second latches 176.

The assembly of the connector assembly 1 will now be described in greater detail with reference to FIGS. 1-7.

The spring clips 200 are inserted into the housing 100 with the cover 160 in the open position O. The spring clips 200 are each inserted into one of the receiving passageways 117 along the longitudinal direction L. During insertion, the latch arm 254 contacts the housing 100 in the closed section 116, deflecting the latch arm 254 toward the spring clip 200 until the spring clip 200 reaches the position shown in FIG. 2, in which the latch arm 254 resiliently deflects away from the connection section 250 into the spring latch passageway 118. The latch arm 254 engages the housing 100 in the spring latch passageway 118 to secure the spring clip 200 in the receiving passageway 117.

With the second beam 230 of the spring clip 200 in the relaxed position R, the FFC 20 is inserted into the interior receiving space 140 of the housing 100 and into the spring clip 200 between the first beam 210 and the second beam 230, as shown in FIG. 2. The contact bend 236 abuts against the upper side 31 of the insulation material 30 when the FFC 20 is fully inserted. In an embodiment, insertion of the FFC 20 deflects the second beam 230 away from the first beam 210 and toward the cover 160 that remains in the open position O. The conductor 40 exposed in the stripped section 33 is positioned along the contact surface 212 of the first beam 210 and, in the shown embodiment, contacts the textured pattern 214. With the FFC 20 inserted in the position shown in FIG. 2, with the cover 160 in the open position O and the second beam 230 in the relaxed position R, the conductor 40 is electrically connected to the spring clip 200 and the contact bend 236 applies a first bend contact force FB1 on the FFC 20, pressing the conductor 40 against the contact surface 212 of the first beam 210. The friction lock 238 does not abut the FFC 20 in the position shown in FIG. 2.

The cover 160 is then moved from the open position O shown in FIG. 2 to the closed position C shown in FIG. 3. The cover 160 exposes the open section 120 in the open position O and encloses the open section 120 in the closed position C. In the shown embodiment, the cover 160 pivots about the hinge 198 from the open position O to the closed position C. As the cover 160 moves from the open position O to the closed position C, the pressing surface 164 contacts the second beam 230 and deflects the second beam 230 toward the first beam 210 from the relaxed position R into the compressed position P.

In the compressed position P, shown in FIG. 3, the friction lock 238 is moved into engagement with the FFC 20 and applies a lock contact force FL pressing the conductor 40 against the contact surface 212 of the first beam 210. The friction lock 238 mechanically engages the FFC 20 in the compressed position P and, in an embodiment, pierces the upper side 31 of the insulation material 30 and electrically contacts the conductor 40. The movement of the spring clip 200 into the compressed position P results in a second bend contact force FB2 applied by the contact bend 236 that is higher than the first bend contact force FB1 in the relaxed position R. The increased second bend contact force FB2 results in better contact of the conductor 40 with the contact surface 212 that is more robust over time and more resistant to vibration. The lock contact force FL and engagement of the friction lock 238 with the FFC 20 secures the FFC 20 against movement along the longitudinal direction L. If the FFC 20 is moved or pulled in the longitudinal direction L, the friction lock 238 resists the movement as it resists rotating out of the compressed position P; the harder the FFC 20 is pulled, the stronger the engagement of the friction lock 238 with the FFC 20 and the stronger the resistance to movement of the FFC 20. In an embodiment, the engagement of the textured pattern 214 with the conductor 40 further secures the contact between the conductor 40 and the spring clip 200 against movement.

As the cover 160 is moved to the closed position C, each of the first latches 174 moves through one of the first latch openings 34 of the FFC 20 and engages one of the first catches 128 of the base 110, as shown in FIG. 5. Likewise, each of the second latches 176 moves through one of the second latch openings 35 of the FFC 20 and engages one of the second catches 132, as shown in FIG. 4. In the closed position C, the engagement of each of the second latches 176 with one of the second catches 132 provides support near the spring clip 200 for maintaining the spring clip 200 in the compressed position P. The engagement of each of the first latches 174 with one of the first catches 128 assists the latching of the second catches 132 by resisting any moment applied to the cover 160 by movement of the FFC 20. The engagement of the latches 174, 176 with the latch openings 34, 35 of the FFC 20 further limit strain on the FFC 20 from impacting the spring clips 200.

In the closed position C, as shown in the embodiment of FIG. 5, each of the standoffs 182 abuts and presses against the upper side 31 of the insulation material 30 of the FFC 20. The standoffs 182 locate a bottoming of the cover 160 in the closed position C and further resist movement of the FFC 20 that could impact the compressed position P of the spring clip 200.

Figure 6:
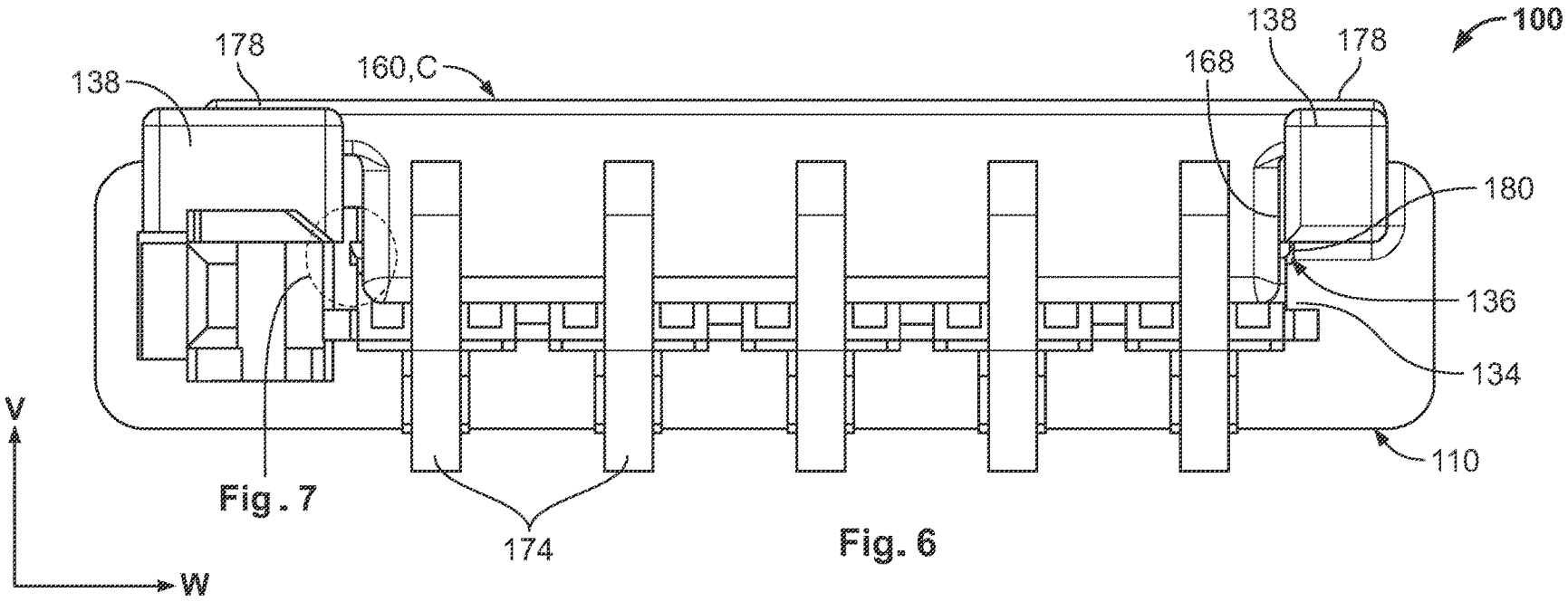
FIG. 6 is a front view of a housing of the connector assembly of FIG. 1 with the cover in a closed position.
Figure 7:
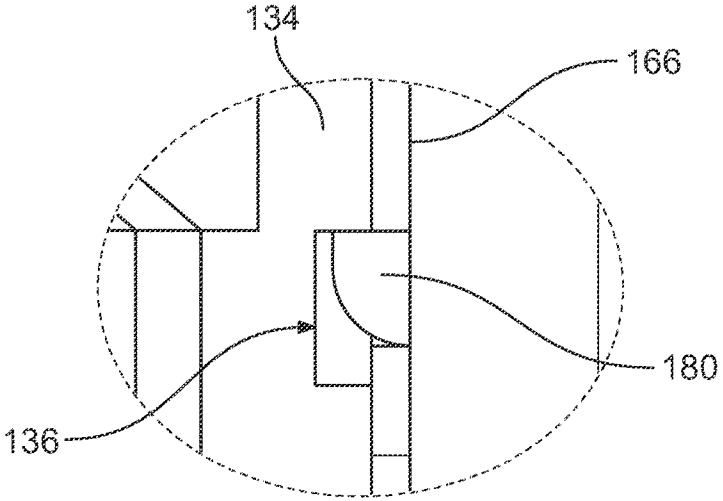
FIG. 7 is a detail view of a portion of FIG. 6.

As shown in FIGS. 6 and 7, in the closed position C, the protrusion 180 on each of the side surfaces 168 engages in a snap-fit in the groove 136 of one of the sidewalls 134. The snap-fit of the protrusions 180 in the grooves 136 further secures the cover 160 in the closed position C.

In the connector assembly 1 according to the first embodiment, in the closed position C of the cover 160, the spring clip 200 is held in the compressed position P by the engagement of the first latches 174 with the first catches 128, the engagement of the second latches 176 with the second catches 132, and the engagement of the protrusions 180 with the grooves 136. The engagement of the latches 174, 176 with the catches 128, 132 limits movement of the cover 160 out of the closed position C in the longitudinal direction L and in the vertical direction V. The engagement of the protrusions 180 with the grooves 136 further limits movement of the cover 160 out of the closed position C in the vertical direction V.

Additionally, in the closed position C, the flanges 178 each abut one of the positioning tabs 138 along the longitudinal direction L, as shown in FIGS. 4 and 6. The abutment of the flanges 178 with the positioning tabs 138 further limits movement of the cover 160 out of the closed position C along the longitudinal direction L. The restrictions on the movement of the cover 160 from the closed position C described herein help to retain the spring clips 200 in the compressed position P, maintaining robust and reliable electrical and mechanical contact between the FFC 20 and the spring clips 200.

A connector assembly 1' according to a second embodiment will now be described with reference to FIGS. 8-17. Like reference numbers refer to like elements and primarily the differences with respect to the first embodiment of the connector assembly 1 shown in FIGS. 1-7 will be described herein.

Figure 8:
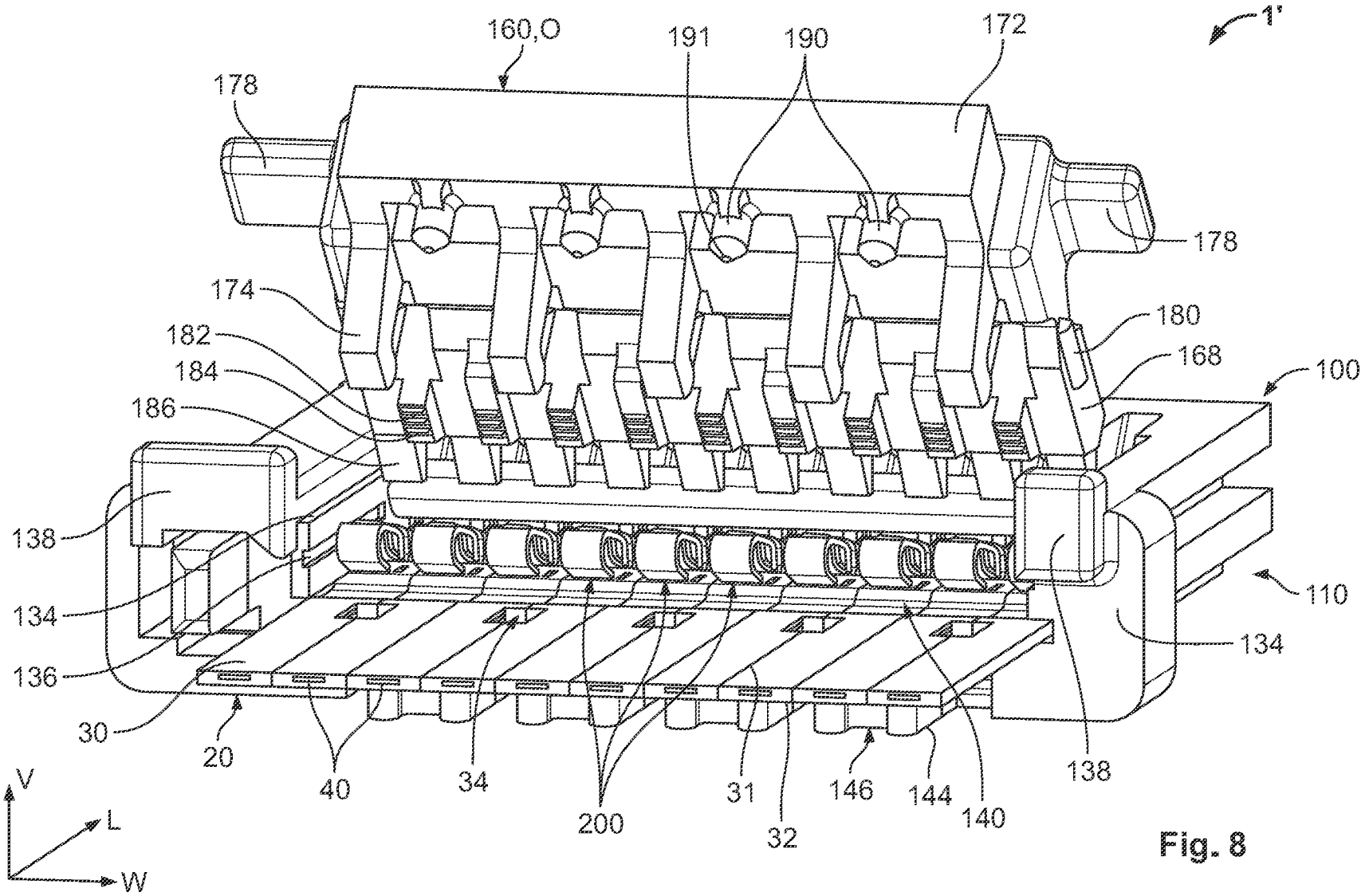
FIG. 8 is a perspective view of a connector assembly according to a second embodiment.
Figure 9:
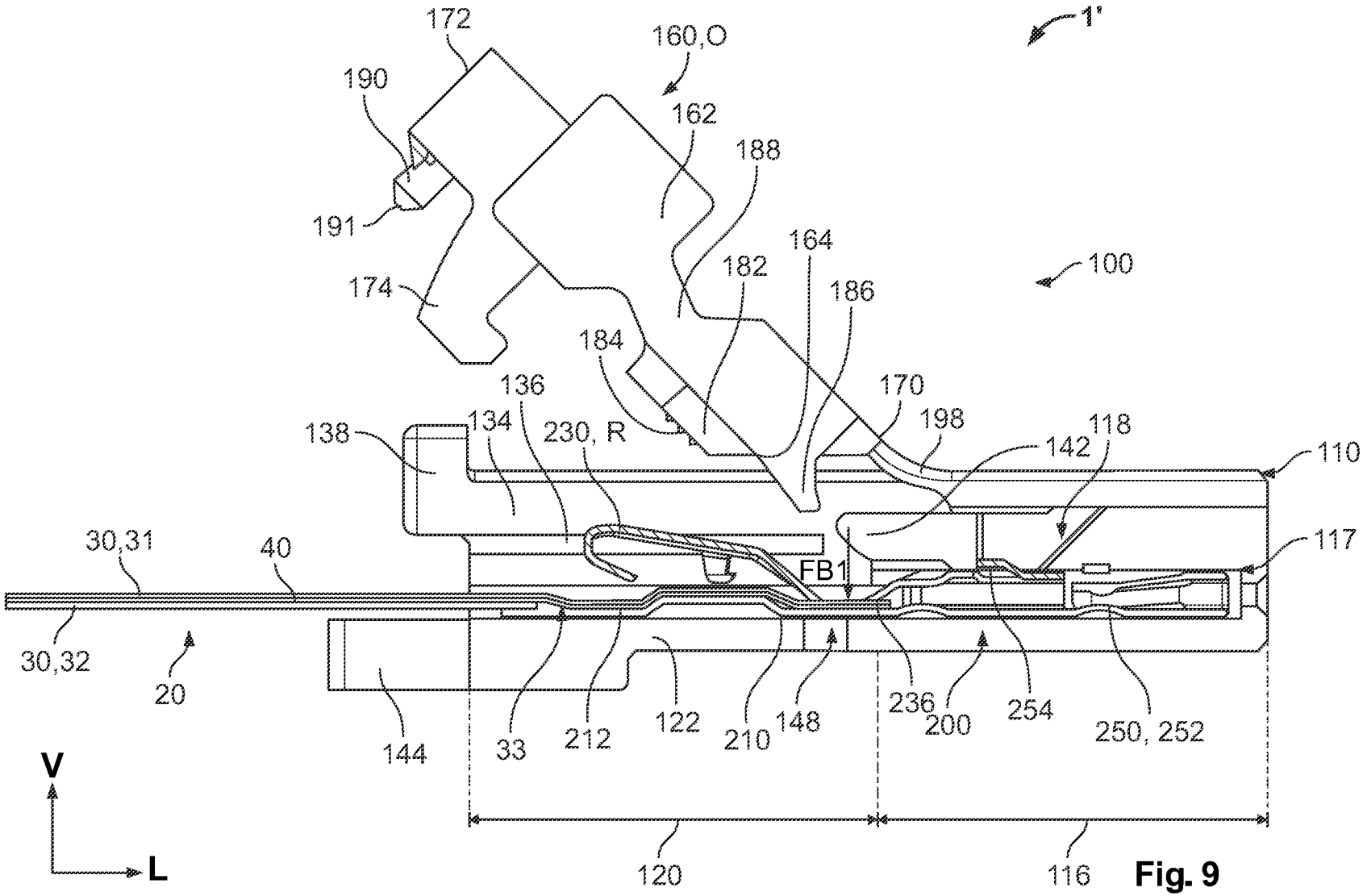
FIG. 9 is a sectional side view of the connector assembly of FIG. 8 with a cover in an open position.
Figure 16:
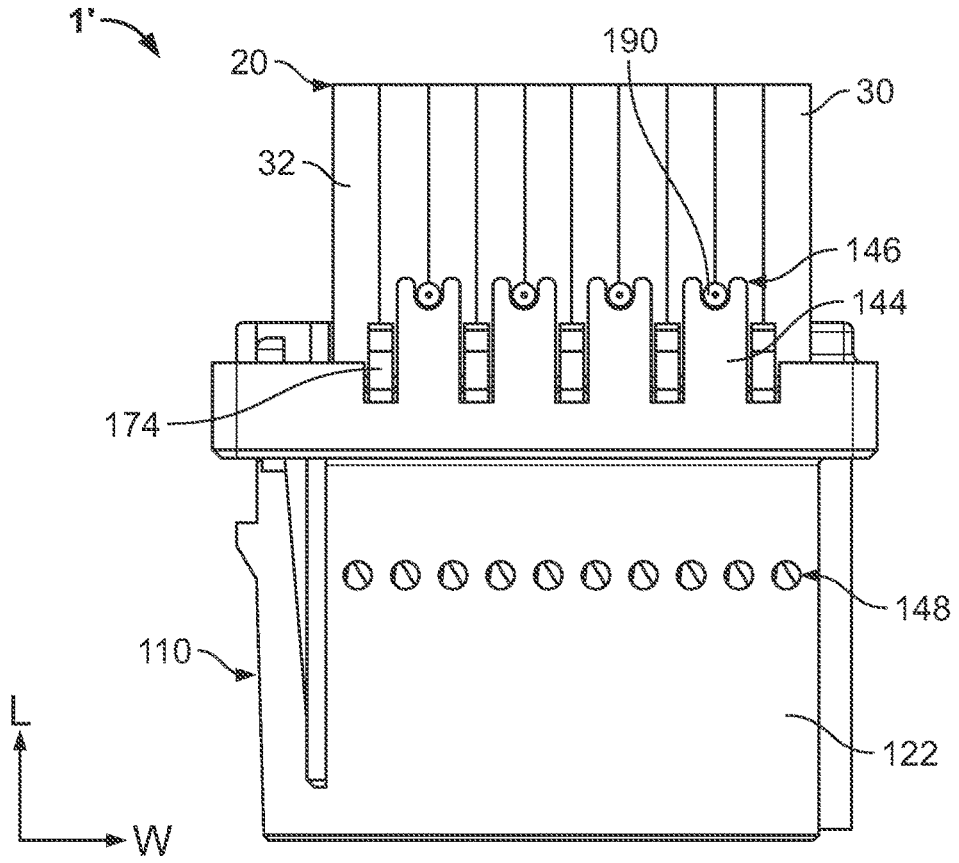
FIG. 16 is a bottom view of the connector assembly of FIG. 8.

In the connector assembly 1', the base 110 of the housing 100 has a base wedge 142 in lieu of each of the second catches 132, as shown in FIG. 9. The base wedge 142 extends from the closed section 116 along the longitudinal direction L and has an approximately triangular shape sloping toward the receiving passageway 117. The base 110, as shown in FIGS. 8 and 9, has a plurality of retention arms 144 extending from the open section 120 along the longitudinal direction L. Each of the retention arms 144 has a retention recess 146 at an end of the retention arm 144, as shown in FIGS. 8 and 16. The base 110 has a plurality of windows 148 extending through the bottom wall 122 in the open section 120, as shown in FIGS. 9 and 16. The number of retention arms 144 and number of windows 148 of the base 110 could differ from those in the shown embodiment, and could be greater than the number shown or as few as one retention arm 144 with one retention recess 146 and one window 148.

The cover 160 of the housing 100 in the connector assembly 1' has a plurality of cover wedges 186 in lieu of the second latches 176, as shown in FIGS. 8 and 9. The cover wedges 186 are positioned at the first end 170 of the main body 162 and, having an approximately triangular shape in the shown embodiment, extend from the pressing surface 164 in the longitudinal direction L and the vertical direction V. The number of cover wedges 186 could differ from the number in the embodiment shown in FIGS. 8 and 9, provided that the number of cover wedges 186 corresponds to the number of base wedges 142.

The main body 162 of the cover 160, as shown in FIG. 9, has a latch beam 188 disposed between the first latch 174 and the cover wedges 186. The latch beam 188 is monolithically formed in a single piece with the cover 160 but is resiliently flexible, allowing some deflection of the first latch 174 with respect to the first end 170 of the main body 162. As shown in the embodiment of FIGS. 8 and 9, the standoffs 182 of the cover 160 may each have a plurality of ribs 184 at a surface opposite the main body 162.

The cover 160, as shown in FIGS. 8 and 9, has a plurality of retention pegs 190 extending from the pressing surface 164 at the second end 172 of the main body 162. Each of the retention pegs 190, in the shown embodiment, is an approximately cylindrical member with a pointed end 191 opposite the main body 162. In an embodiment, the pointed end 191 of each of the retention pegs 190 is sufficiently sharp to penetrate the insulation material 30 of the FFC 20. The number of retention pegs 190 could differ from the number in the shown embodiment, provided that the number of retention pegs 190 corresponds to the number of retention recesses 146. In other embodiments, an exterior shape of the retention pegs 190 could differ from the cylindrical shape of the shown embodiment, provided that the shape of the retention pegs 190 corresponds to the shape of the retention recesses 146.

Figure 10A:
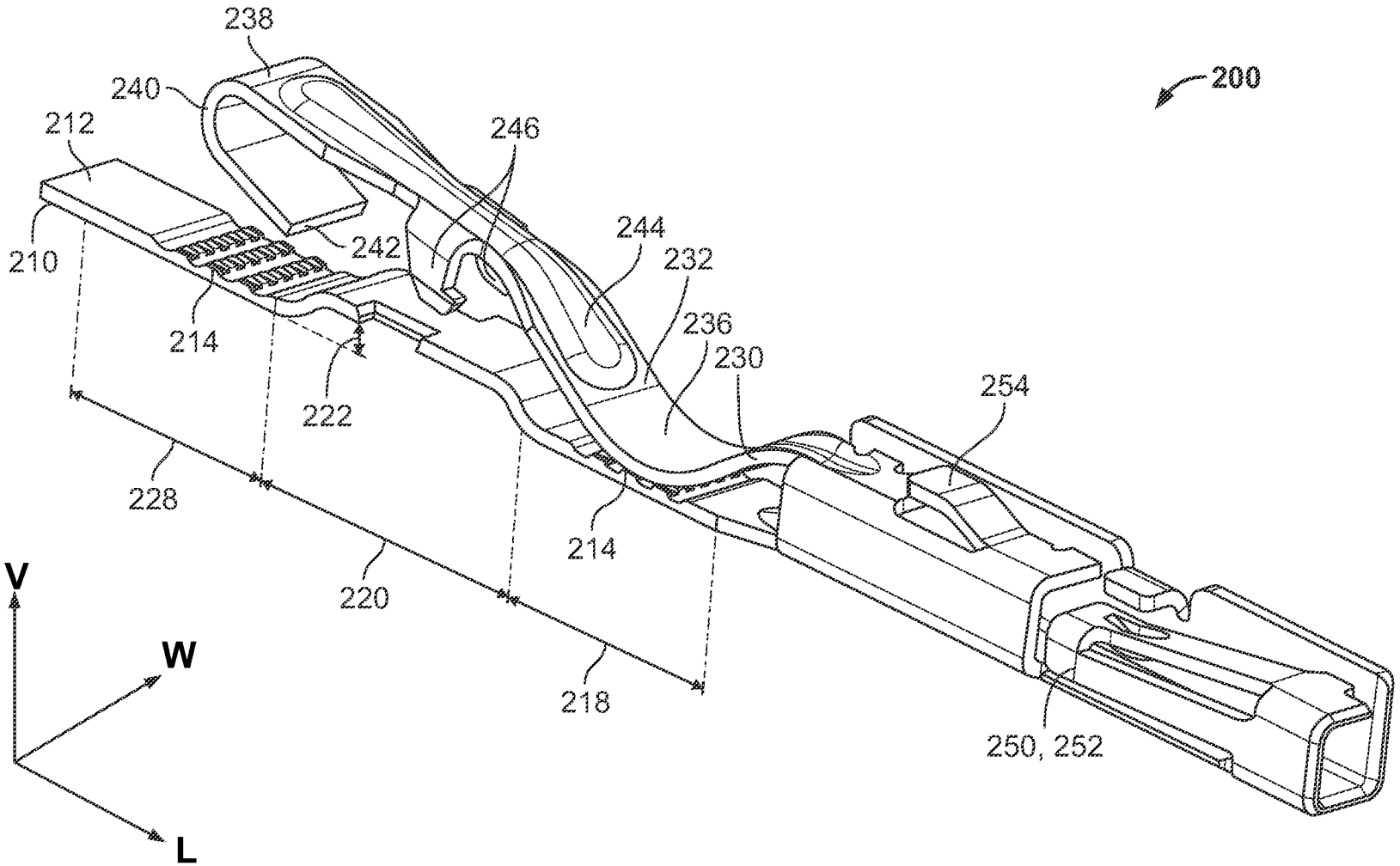
FIG. 10A is a perspective view of a spring clip of the connector assembly of FIG. 8.
Figure 10B:
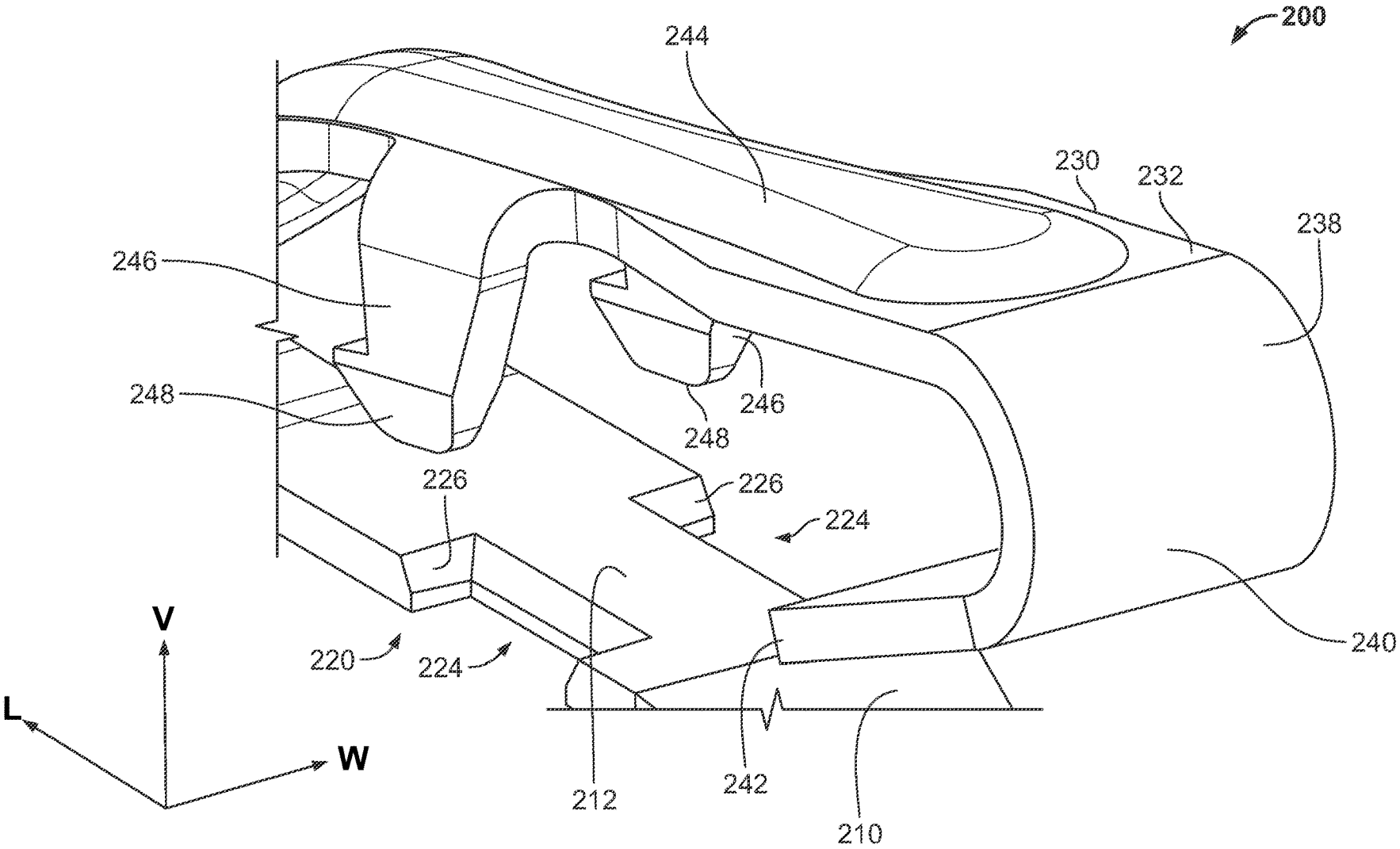
FIG. 10B is a detail perspective view of a portion of the spring clip of FIG. 10A.

The spring clip 200 of the connector assembly 1' is shown in detail in FIGS. 10A and 10B. The first beam 210, along the longitudinal direction L, has a first contact section 218, a second contact section 228, and a latch section 220 between the first contact section 218 and the second contact section 228. In the shown embodiment, the textured pattern 214 is disposed on the contact surface 212 in each of the first contact section 218 and the second contact section 228.

The latch section 220 is bent with respect to the first contact section 218 and the second contact section 228 and, in the embodiment shown in FIG. 10A, is positioned above the first contact section 218 and the second contact section 228 in the vertical direction V by a latch height 222. In other embodiments, the latch section 220 could be positioned below or flush with the first contact section 218 and the second contact section 228 in the vertical direction V. The latch section 220, as shown in FIG. 10B, has a pair of indents 224 extending into opposite sides of the first beam 210 in the width direction W. Each of the indents 224 has a slope 226 extending from the contact surface 212 of the first beam 210, surrounding the indent 224, and sloping toward the indent 224.

The second beam 230, as shown in FIGS. 10A and 10B, has the friction lock 238 with a bent portion 240 bent back toward the first beam 210 and the connection section 250. The bent portion 240 ends in an edge 242 extending in the width direction W. The bent portion 240 can be bent back toward the connection section 250, in various embodiments, at an angle between 90 degrees and 180 degrees, or at any other angle that allows the engagement of friction lock 238 as described herein. The contact bend 236 is aligned with the first contact section 218 and the friction lock 238 is aligned with the second contact section 228.

The second beam 230 has an embossment 244 extending along a portion of an exterior surface 232 of the second beam 230, as shown in the embodiment of FIGS. 10A and 10B. The embossment 244 is a thickening of the material of the second beam 230 and stiffens the second beam 230 in the area of the embossment 244. The shown embodiment is exemplary and, in other embodiments, the embossment 244 can extend along any portion of the exterior surface 232 of the second beam 230, including up to along an entire length of the exterior surface 232 of the second beam 230 along the longitudinal direction L. In a spring clip 200' according to another embodiment, as shown in FIG. 11, the embossment 244 could extend along an interior surface 234 of the second beam 230, or could additionally or alternatively extend along the first beam 210.

Figure 11:
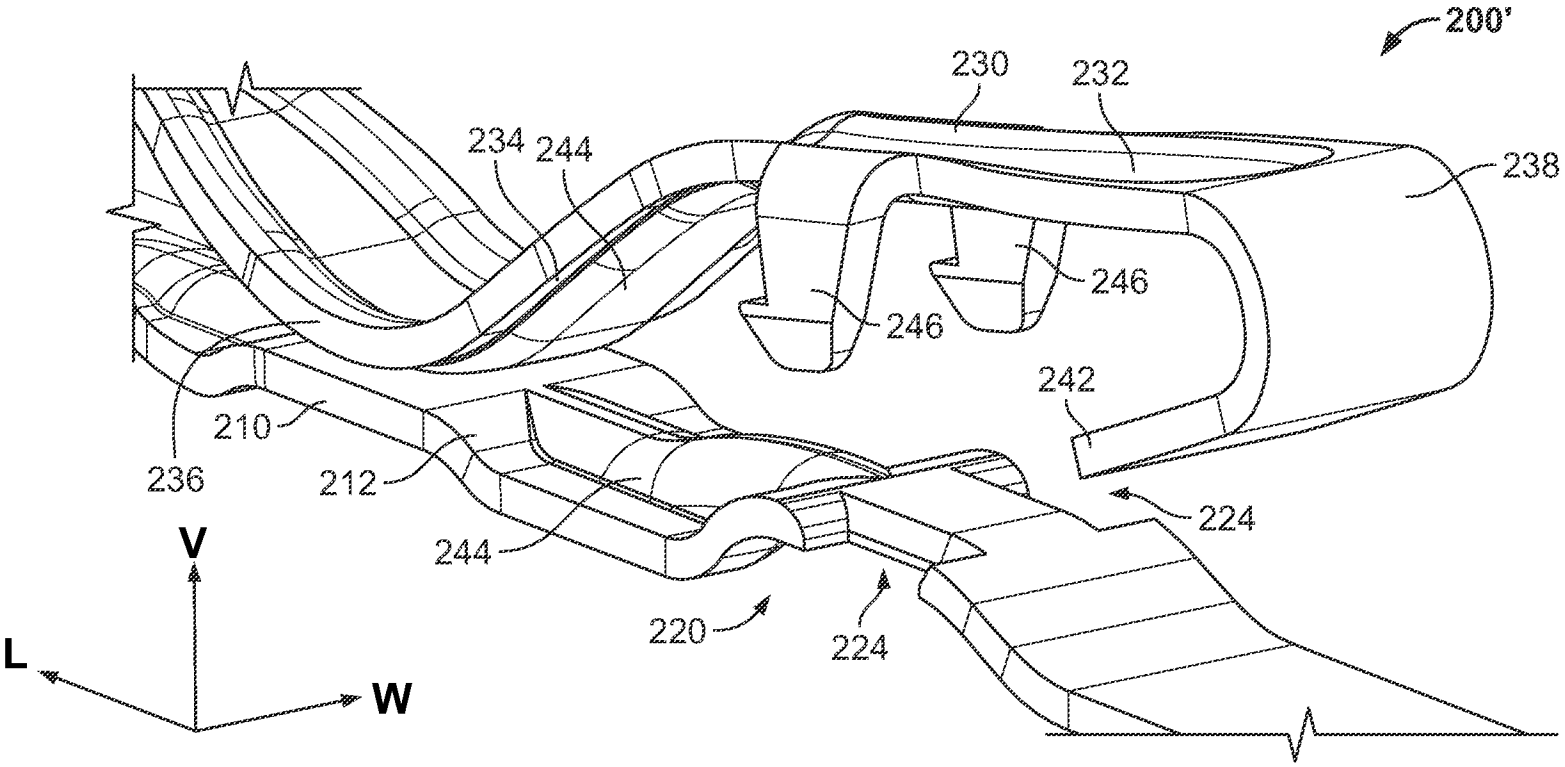
FIG. 11 is a detail perspective view of a portion of a spring clip according to another embodiment.

As shown in the embodiments of FIGS. 10A-11, the second beam 230 has a pair of spring latches 246 extending from the second beam 230 toward the first beam 210. Each of the spring latches 246 has a sharp free end 248 opposite the second beam 230, as shown in FIG. 10B. The spring latches 246 are resiliently deflectable with respect to the second beam 230. In the shown embodiment, the spring latches 246 are monolithically formed in a single piece with the second beam 230 and the first beam 210 and are bent from the second beam 230 into the orientation shown in FIGS. 10A-11. In other embodiments, the spring latches 246 could be formed separately and attached to the second beam 230.

The second beam 230 has two spring latches 246 in the shown embodiments but, in other embodiments, may have only one or more than two spring latches 246. The spring latches 246 in the shown embodiment each extend in a plane defined by the longitudinal direction L and the vertical direction V. In other embodiments, the spring latches 246 may extend perpendicular to the orientation shown in the embodiments of FIGS. 10A-11; each in a plane defined by the width direction W and the vertical direction V.

Figure 12:
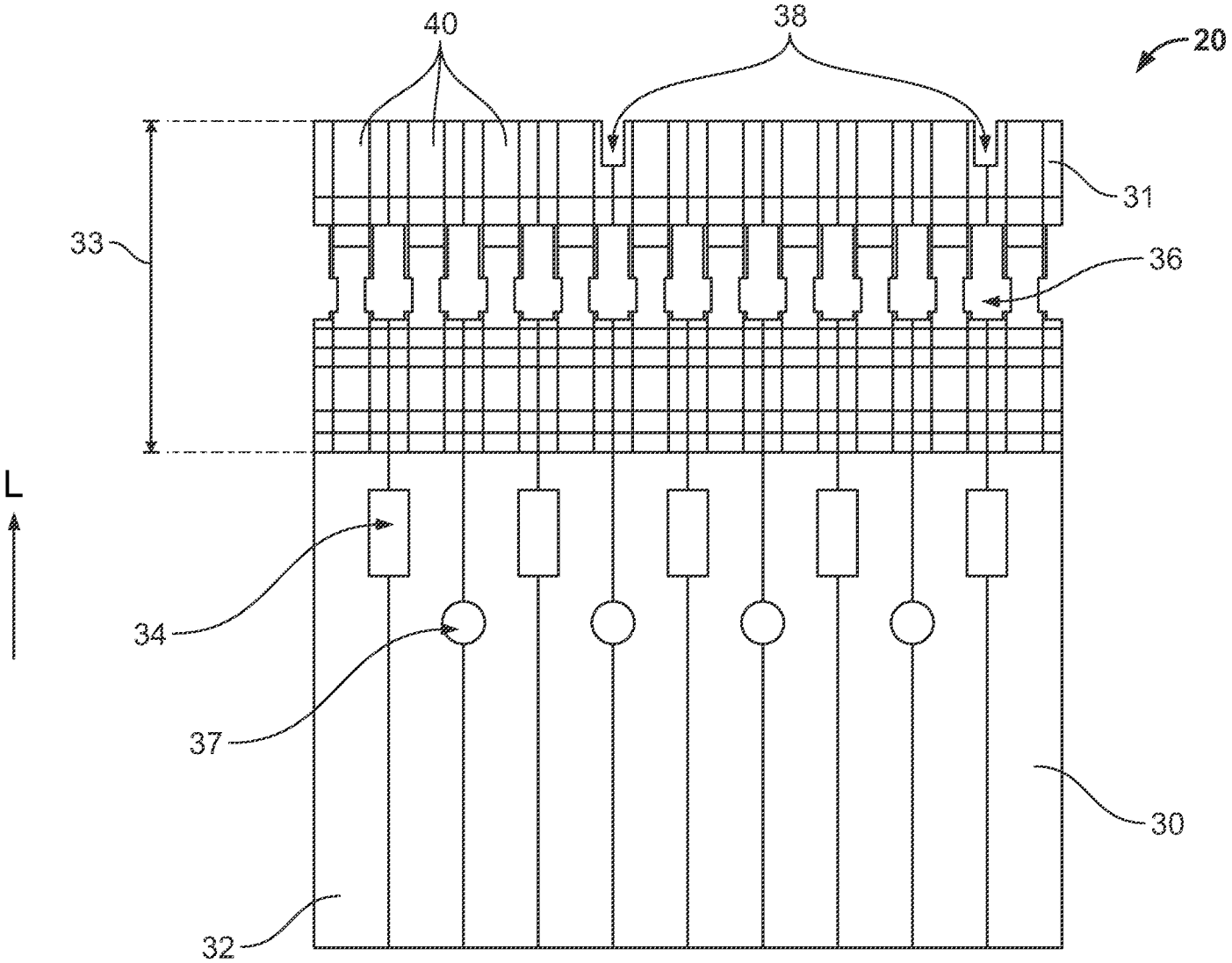
FIG. 12 is a bottom plan view of a flat flexible cable according to an embodiment.

The FFC 20 of the connector assembly 1' is shown in detail in FIG. 12; the orientation of FIG. 12 is facing the lower side 32 of the insulation material 30 to show the conductors 40 exposed in the stripped section 33. In the embodiment shown in FIG. 12, the FFC 20 has a plurality of standoff openings 36 extending through the insulation material 30 in the stripped section 33 between the conductors 40 and has a plurality of peg openings 37 extending through the insulation material 30 between the conductors 40. The number of standoff openings 36 corresponds to the number of standoffs 182 and the number of peg openings 37 corresponds to the number of pegs 190.

In the embodiment shown in FIG. 12, the FFC 20 has a pair of key slots 38 extending into an end of the FFC 20 in the stripped section 33. The positioning and number of the key slots 38 in the shown embodiment are merely exemplary, and any number of key slots 38 can be positioned in any arrangement at the end of the FFC 20 in other embodiments.

The assembly of the connector assembly 1' will now be described in greater detail primarily with reference to FIGS. 8, 9, and 13A-14.

The spring clips 200 are inserted into the housing 100 with the cover 160 in the open position O. As described above, the spring slips 200 are inserted into the receiving passageway 117 and secured in the receiving passageways 117 by engagement of the latch arm 254 with the spring latch passageway 118, as shown in FIG. 9. The FFC 20 is inserted into the spring clip 200 between the first beam 210 and the second beam 230 with the second beam 230 in the relaxed position R and the cover 160 in the open position O. As shown in FIG. 9, the conductor 40 is electrically connected to the spring clip 200 and the contact bend 236 applies a first bend contact force FB1 on the FFC 20, pressing the conductor 40 against the contact surface 212 of the first beam 210 in the first contact section 218.

Figure 13A:
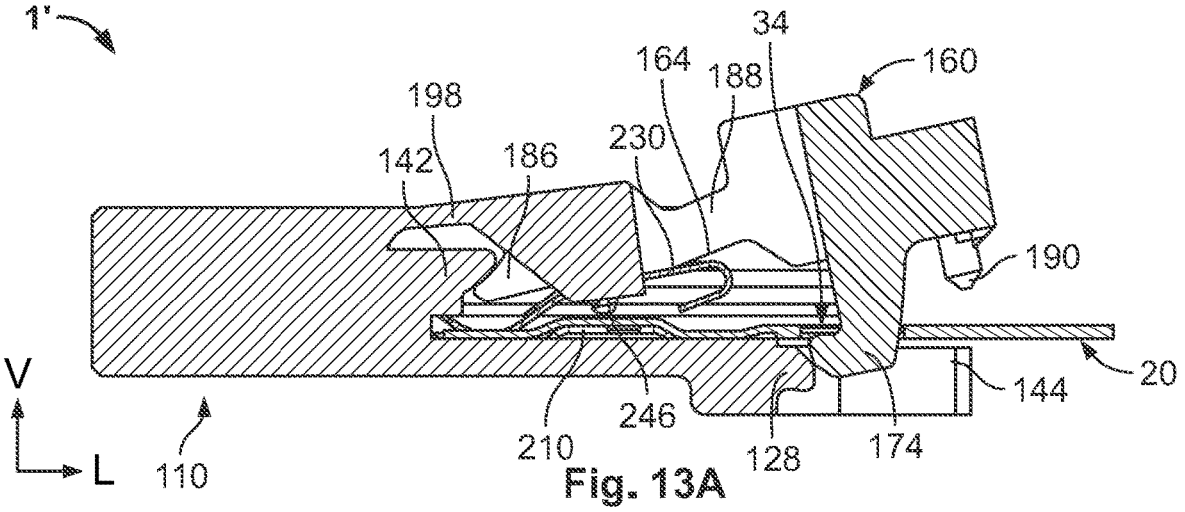
FIG. 13A is a sectional side view of the connector assembly of FIG. 8 with the cover in a first state of moving toward a closed position.
Figure 13B:
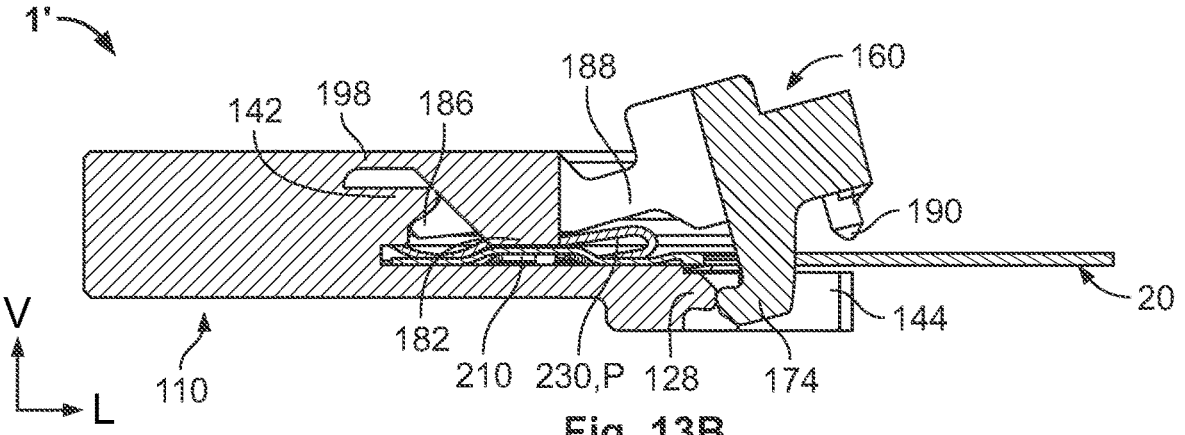
FIG. 13B is a sectional side view of the connector assembly of FIG. 8 with the cover in a second state of moving toward the closed position.
Figure 13C:
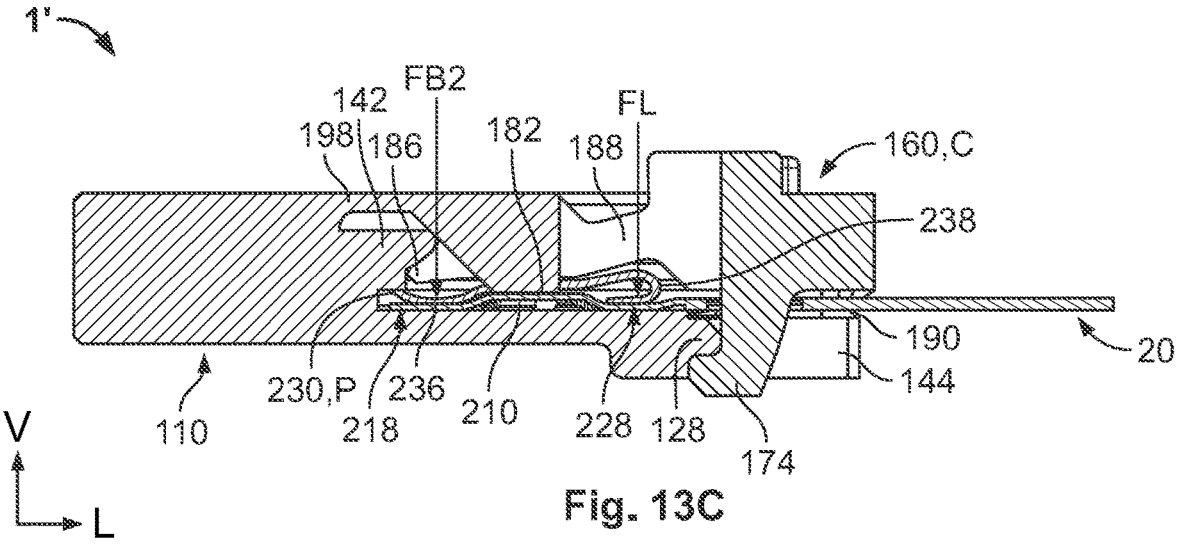
FIG. 13C is a sectional side view of the connector assembly of FIG. 8 with the cover in the closed position.

The cover 160 is then moved from the open position O shown in FIG. 9 to the closed position C, according to the sequence shown in FIGS. 13A-13C. The cover 160 pivots about the hinge 198 from the open position O to the closed position C.

As the cover 160 beings to move toward the closed position C, from the position shown in FIG. 9 to the position shown in FIG. 13A, the cover wedge 186 abuts the base wedge 142 and moves along the base wedge 142 as the cover 160 pivots about the hinge 198. In the position shown in FIG. 13A, the first latch 174 has moved through one of the first latch openings 34 of the FFC 20 and initially contacts the first catch 128. In this position, the pressing surface 164 contacts the second beam 230 and beings to press the second beam 230 toward the first beam 210.

The contact of the first latch 174 with the first catch 128 forces the first latch 174 outward during continued movement of the cover 160 toward the closed position C by flexure of the latch beam 188, as shown in FIG. 13B. The cover wedge 186 is fully engaged with the base wedge 142 and the second beam 230 has been moved to the compressed position P described above pressing the FFC 20 against the first beam 210. The standoff 182 abuts against the FFC 20 in the embodiment shown in FIG. 13B. In this position, due to the flexure of the latch beam 188, the first latch 174 may still not be fully engaged with the first catch 128 when the second beam 230 reaches the compressed position P.

As the cover 160 moves into the closed position C shown in FIG. 13C, the first latch 174, under an elastic restoration of the latch beam 188, fully engages the first catch 128. The retention peg 190 moves through one of the peg openings 37 of the FFC 20 and is positioned in the retention recess 146 of one of the retention arms 144, as also shown in FIG. 16. The retention pegs 190 retain the FFC 20 while the positioning of the pegs 190 in the retention recesses 146 allows for a visual confirmation that the cover 160 has reached the closed position C.

In the compressed position P of the second beam 230 and the closed position C of the cover 160, the contact bend 236 applies the second bend contact force FB2 in the first contact section 218 and the friction lock 238 applies the lock contact force FL described above in the second contact section 228, as shown in FIG. 13C. The spring clip 200 is held in the compressed position P by the engagement of the first latches 174 with the first catches 128, the engagement of the cover wedges 186 with the base wedges 142, and the engagement of the protrusions 180 with the grooves 136. The engagement of the latches 174 with the catches 128 and the engagement of the wedges 142, 186 limits movement of the cover 160 out of the closed position C in the longitudinal direction L and in the vertical direction V. The engagement of the protrusions 180 with the grooves 136 further limits movement of the cover 160 out of the closed position C in the vertical direction V. The abutment of the flanges 178 with the positioning tabs 138 further limits movement of the cover 160 out of the closed position C along the longitudinal direction L.

In the connector assembly 1', the spring clip 200 retains itself in the compressed position P. As the pressing surface 164 presses the second beam 230 toward the first beam 210, the sharp free end 248 of each of the spring latches 246 moves through the FFC 20, either by piercing the insulation material 30 or through a pre-made hole, and abuts the slope 226 of the indents 224 shown in FIGS. 10B and 14. Further movement of the second beam 230 toward the first beam 210 under the pressing of the pressing surface 164 deflects the spring latches 246 by contact with the slopes 226 as the spring latches 246 move into the indents 224 along the vertical direction V.

Figure 14:
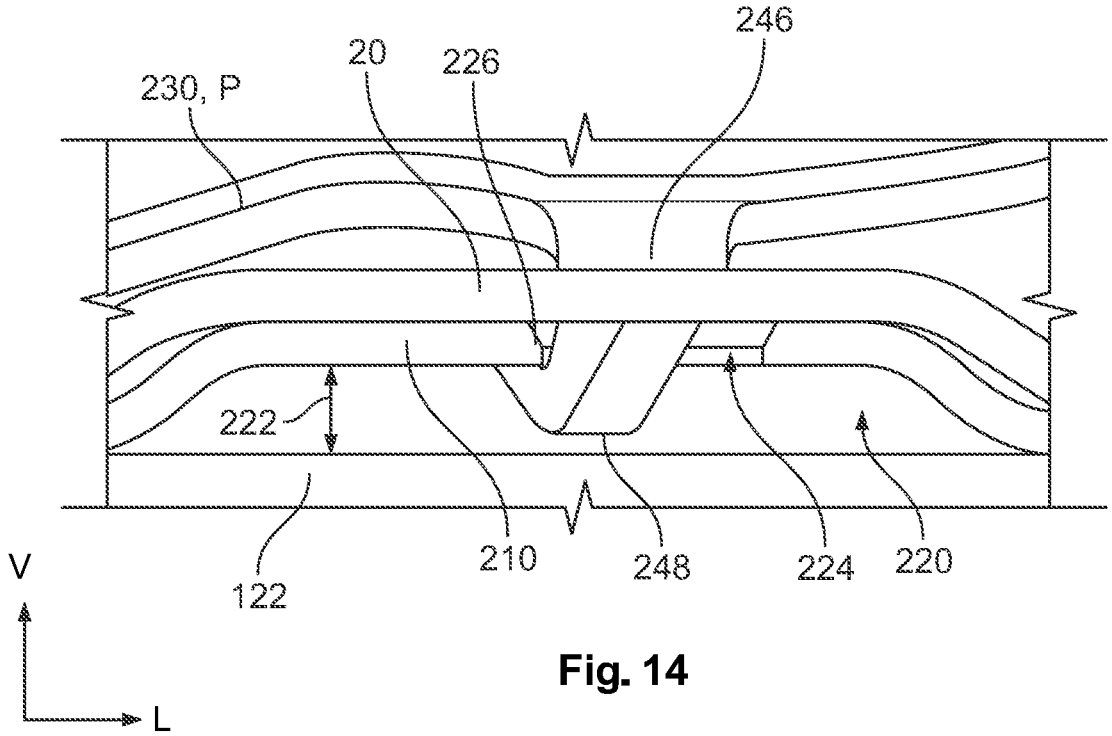
FIG. 14 is a detail sectional side view of the spring clip of FIG. 10A in the closed position of the cover.

When the spring latches 246 reach the position shown in FIG. 14, the spring latches 246 elastically restore and engage the first beam 210 to secure the second beam 230 in the compressed position P. The spring latches 246 are each positioned in one of the indents 224 when the spring latches 246 engage the first beam 210 in the compressed position P. The latch height 222 is sized so that the spring latches 246 have sufficient clearance to the bottom wall 122 to engage the first beam 210. The bottom wall 122 can also act as a stop that, by abutment with the sharp free ends 248 of the spring latches 246, prevents over-compression of the second beam 230 toward the first beam 210.

The engagement of the spring latches 246 with the first beam 210, independently of and in addition to the aforementioned latching and engagements of the housing 100 in the closed position C, further maintains the second bend contact force FB2 in the first contact section 218 and the lock contact force FL in the second contact section 228. In an embodiment in which the spring clip 200 is made of a metal or other material resistant to deformation over time, the engagement of the spring latches 246 with the first beam 210 may suffer less degradation and creep over time than a plastic retention of the second beam 230 in the compressed position P. Pulling of the FFC 20 along the longitudinal direction L out of the housing 100 will further cause the friction lock 238 to pivot while maintaining the lock contact force FL and, due to the stiffness of the embossment 244, will form a lever increasing the second bend contact force FB2 in the first contact section 218. Even if the spring clip 200 retracts slightly when the cover 160 reaches the closed position C, the engagement of the spring latches 246 with the first beam 210 ensures that the necessary forces FB2, FL are maintained.

The two spring latches 246 straddle one of the conductors 40 in an embodiment. In another embodiment, only one spring latch 246 can be used or more than two spring latches 246 can be used, provided the application of the forces FB2, FL are balanced and maintained an the spring latches 246 do not pierce one of the conductors 40. The spring latches 246 of the shown embodiment deflect along a plane defined by the vertical direction V and the longitudinal direction L when moving into engagement with the first beam 210. In another embodiment, the spring latches 246 may deflect along a perpendicular plane defined by the vertical direction V and the width direction W when moving into engagement with the first beam 210.

Figure 15:
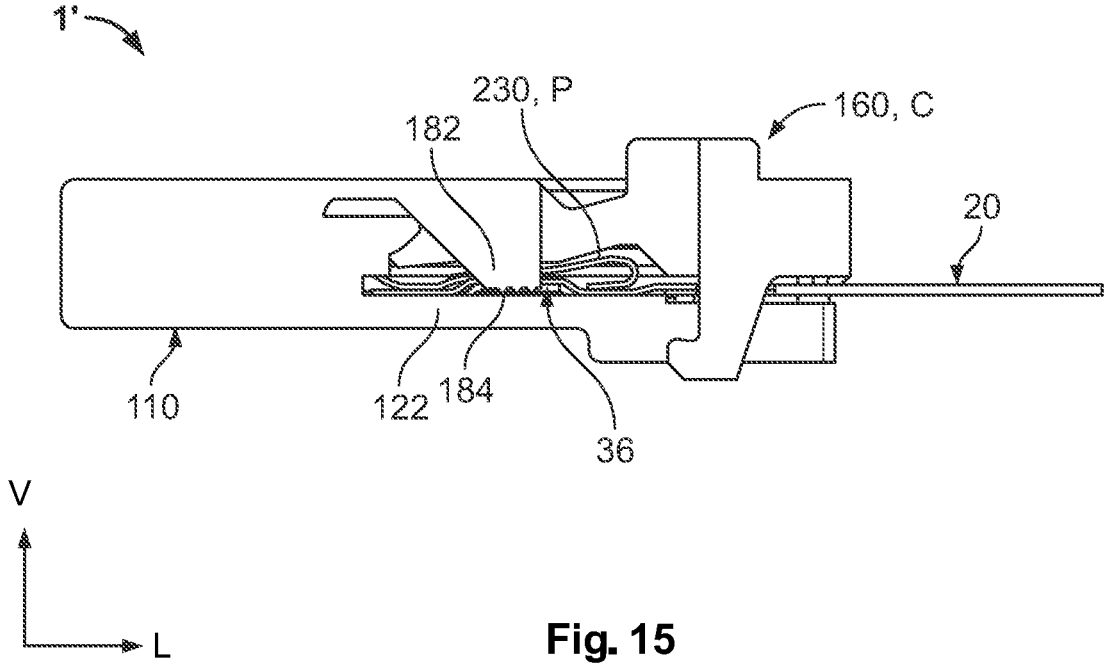
FIG. 15 is a sectional side view of the connector assembly of FIG. 8 with a cover according to another embodiment in the closed position.

In the embodiment shown in FIGS. 13A-13C, the standoffs 182 are configured to abut and press the FFC 20 in the closed position C of the cover 160. In another embodiment, as shown in FIG. 15, the standoffs 182 each extend through one of the standoff openings 35 of the FFC 20 and abut the bottom wall 122 in the closed position C. In the embodiment shown in FIG. 15, the ribs 184 of the standoffs 182 abut the bottom wall 122.

Figure 17:
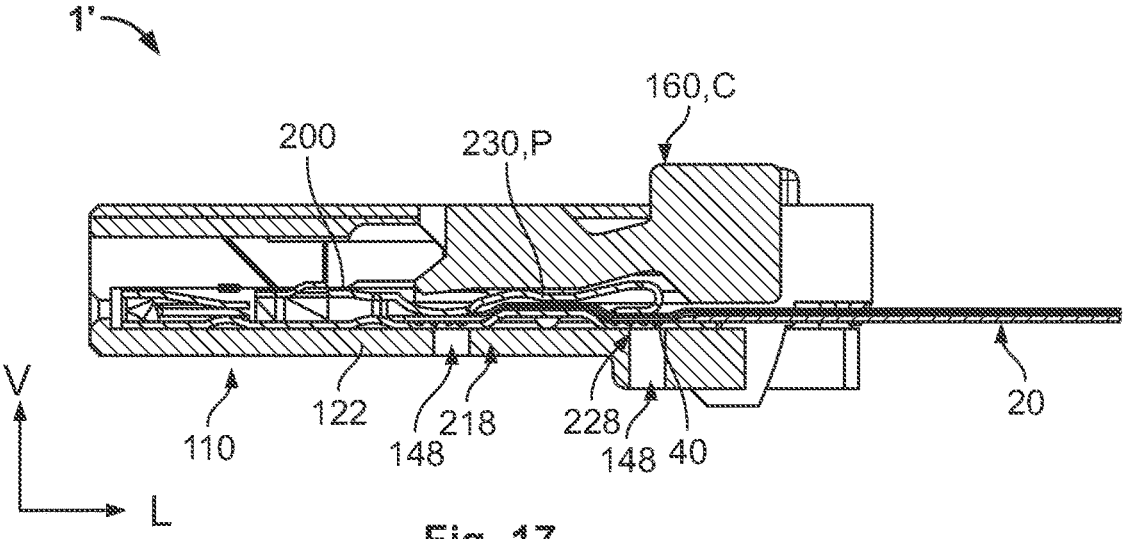
FIG. 17 is a sectional side view of the connector assembly of FIG. 8 with a base according to another embodiment.

As shown in FIGS. 16 and 17, in the connector assembly 1', the windows 148 extend through the bottom wall 122 of the base 110. In the embodiment of FIG. 16, the windows 148 are positioned in a single row along the width direction W. In the embodiment of FIG. 17, the windows 148 are positioned separated along the longitudinal direction, with one of the windows 148 aligned with the first contact section 218 and one of the windows 148 aligned with the second contact section 228. The conductor 40 can be welded to the spring clip 200 in the compressed position P in at least one of the first contact section 218 and the second contact section 228 through the windows 148.

A connector assembly 1" according to a third embodiment will now be described with reference to FIGS. 18-22. Like reference numbers refer to like elements and primarily the differences with respect to the first embodiment of the connector assembly 1 and the second embodiment of the connector assembly 1' shown in FIGS. 1-17 will be described herein.

Figure 19:
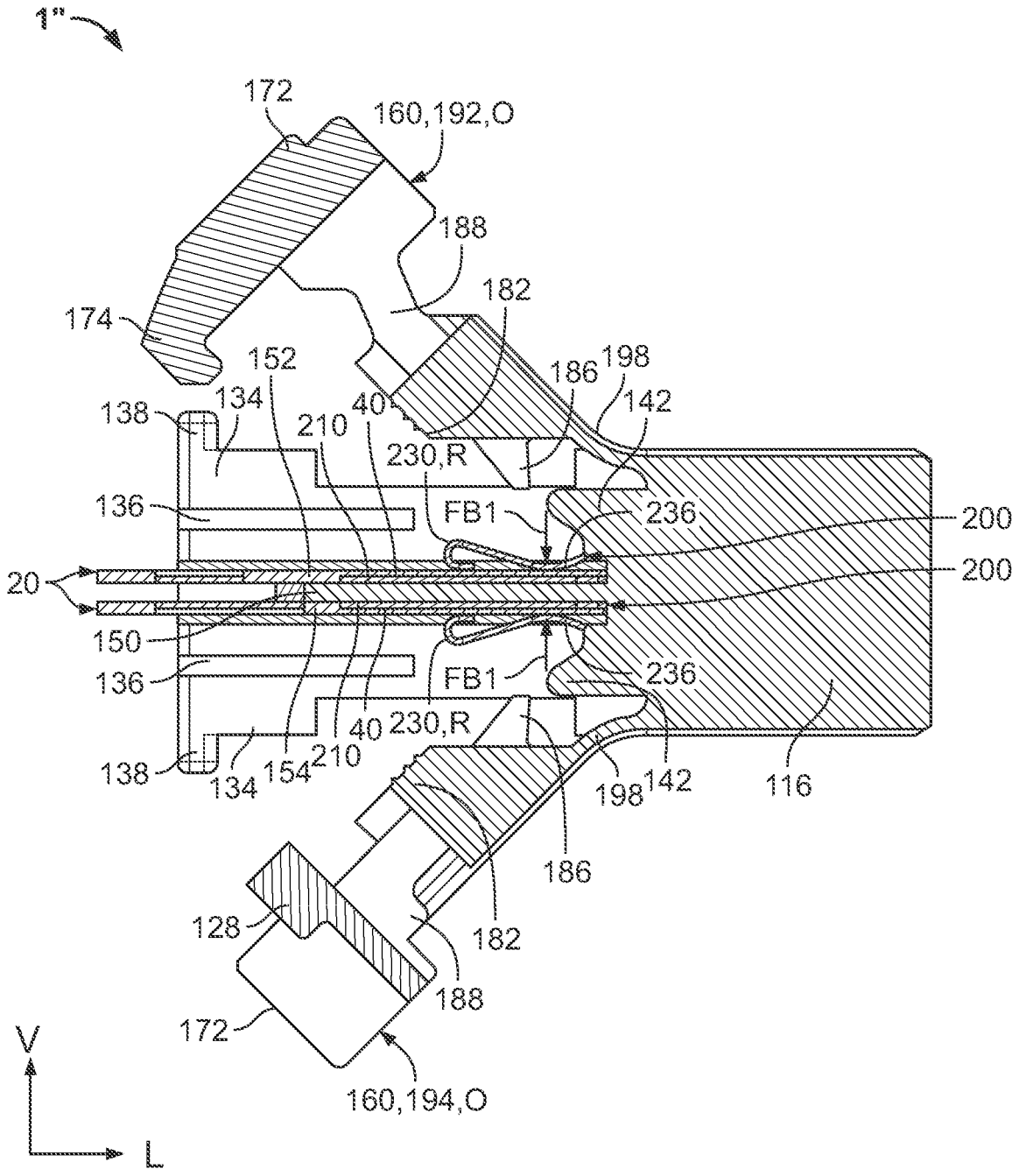
FIG. 19 is a sectional side view of the connector assembly of FIG. 18 with a first cover in an open position and a second cover in an open position.

In the connector assembly 1", the base 110 of the housing 100 has a central wall 150 in lieu of the bottom wall 122, as shown in FIG. 19. The central wall 150 has a first side 152 and a second side 154 opposite the first side 152 in the vertical direction V. The sidewalls 134 of the base 110 extend on both sides of the central wall 150 in the shown embodiment and have mirror symmetrical grooves 136 and positioning tabs 138 about the central wall 150.

Figure 18:
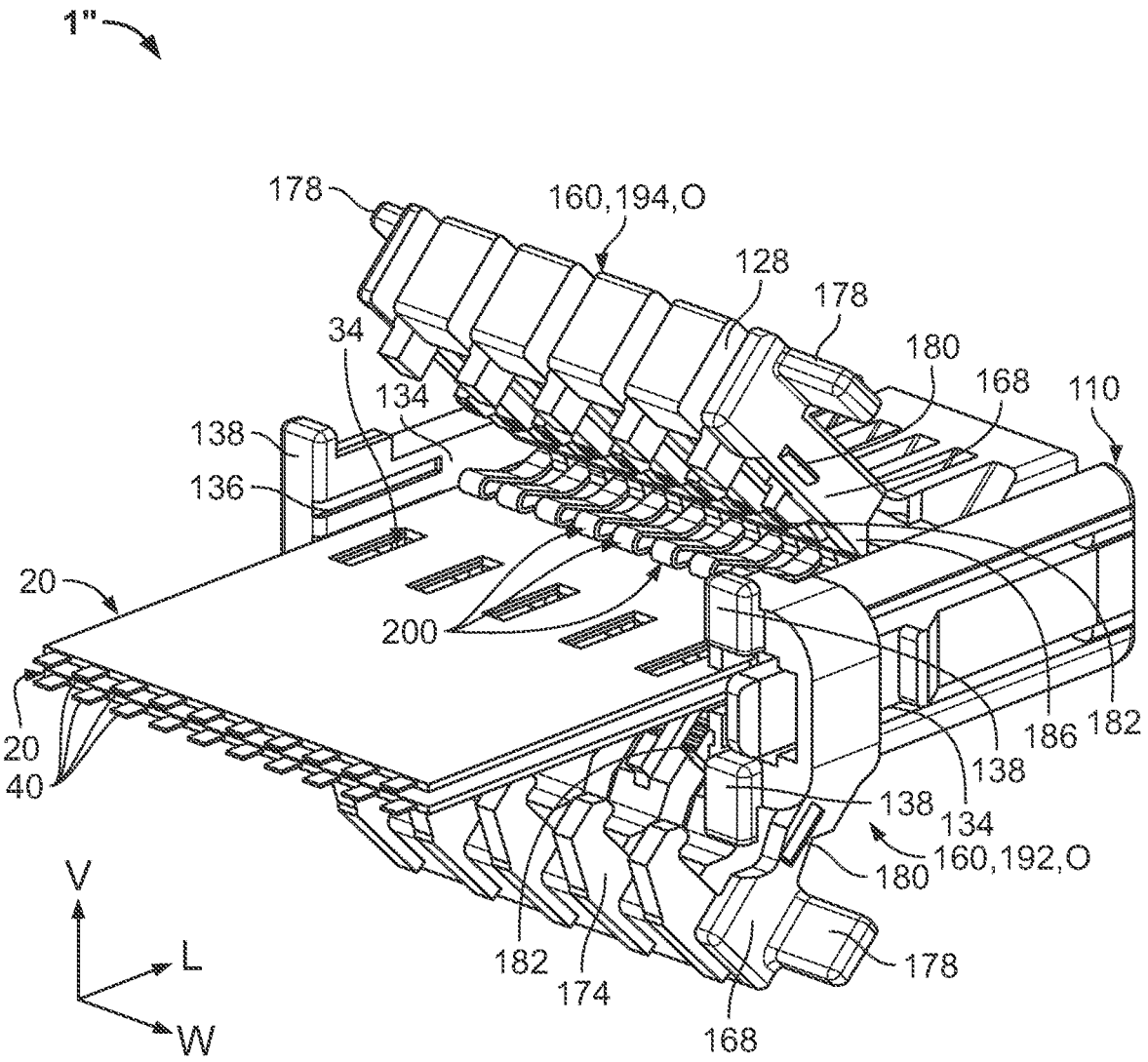
FIG. 18 is a perspective view of a connector assembly according to a third embodiment.

The cover 160 of the housing 100 in the connector assembly 1" includes a first cover 192 and a second cover 194, as shown in FIGS. 18 and 19. The first cover 192 and the second cover 194 are disposed on opposite sides of the central wall 150. The first cover 192 and the second cover 194 are each connected to the base 110 by a hinge 198 and are rotatable about the hinge 198 between an open position O and a closed position C. The first cover 192 exposes the first side 152 of the central wall 150 in the open position O and encloses the first side 152 of the central wall 150 in the closed position C. The second cover 194 exposes the second side 154 of the central wall 150 in the opening position O and encloses the second side 154 of the central wall 150 in the closed position C.

As shown in FIG. 19, the first cover 192 is similar to the cover 160 of the connector assembly 1', having the standoff 182, the cover wedge 186, the latch beam 188, and the first latch 174 at the second end 172. The second cover 194 is mirror symmetrical to the first cover 192 about the central wall 150, except the second cover 194 has the first catch 128 at the second end 172. As shown in FIG. 18, each of the first cover 192 and the second cover 194 has the protrusions 180 on the side surfaces 168 and the flanges 178.

The spring clip 200 of the connector assembly 1", in the shown embodiment, is identical to the spring clip 200 of the connector assembly 1. In another embodiment, the spring clip 200 of the connector assembly 1" can be the spring clip 200 of the connector assembly 1'.

As shown in FIG. 19, with the first cover 192 and the second cover 194 each in the open position O, one FFC 20 is inserted along the first side 152 of the central wall 150 into the spring clips 200 disposed on the first side 152 and another FFC 20 is inserted along the second side 154 of the central wall 150 into the spring clips 200 disposed on the second side 154. As described above, in the relaxed position R of the second beam 230 shown in FIG. 19, each of the spring clips 200 applies the first bend contact force FB1 on the FFC 20 at the contact bend 236, pressing the conductor 40 against the first beam 210. In the embodiment shown in FIG. 19, the spring clips 200 on opposite sides 152, 154 of the central wall 150 apply the first bend contact force FB1 opposing each other along the vertical direction V.

Figure 20:
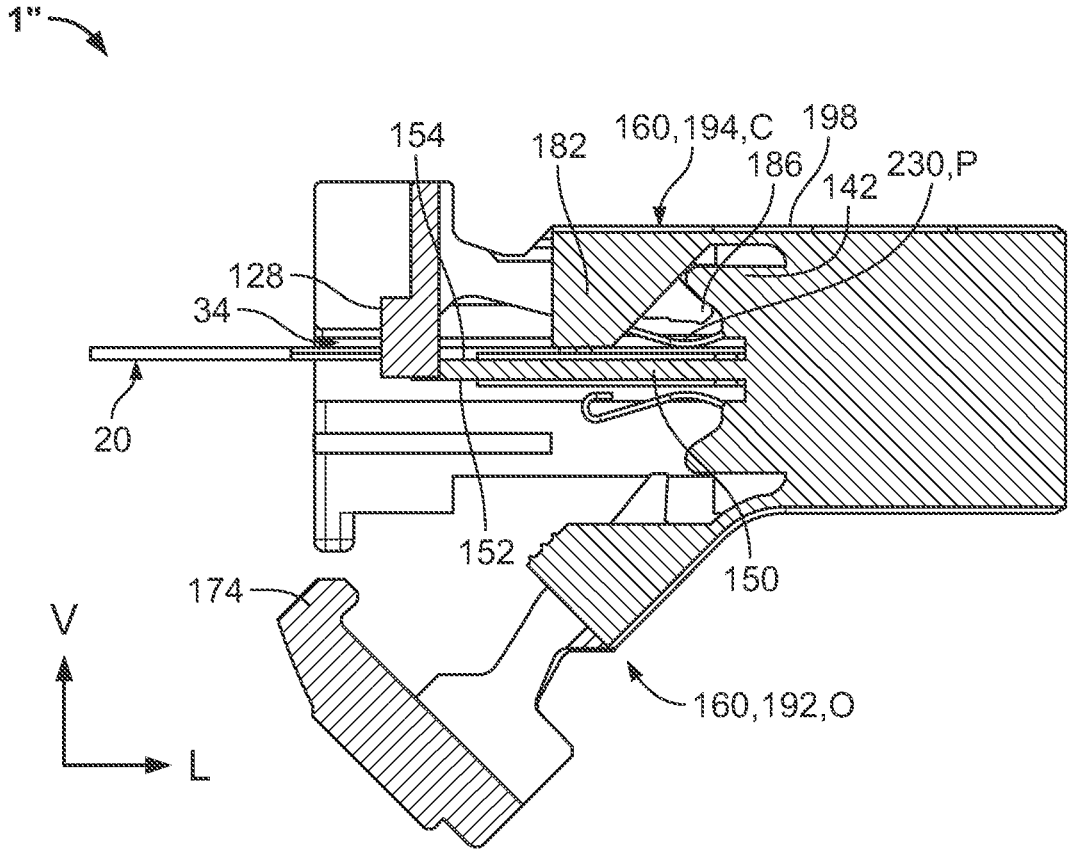
FIG. 20 is a sectional side view of the connector assembly of FIG. 18 with the first cover in the open position and the second cover in a closed position.

The second cover 194 is then moved from the open position O shown in FIG. 19 to the closed position C shown in FIG. 20. The cover wedge 186 moves along the base wedge 142 as the second cover 194 rotates about the hinge 198 into the closed position C, in which the second cover 194 moves the second beam 230 into the compressed position P as described above. In the closed position C of the second cover 194, the first catch 128 is positioned in one of the first latch openings 34 of the FFC 20 on the second side 154 of the central wall 150. The second cover 194 is retained in the closed position C, while the first cover 192 remains in the open position O, by snap-fit engagement of the protrusions 180 with the grooves 136, as shown in FIG. 22.

Figure 21:
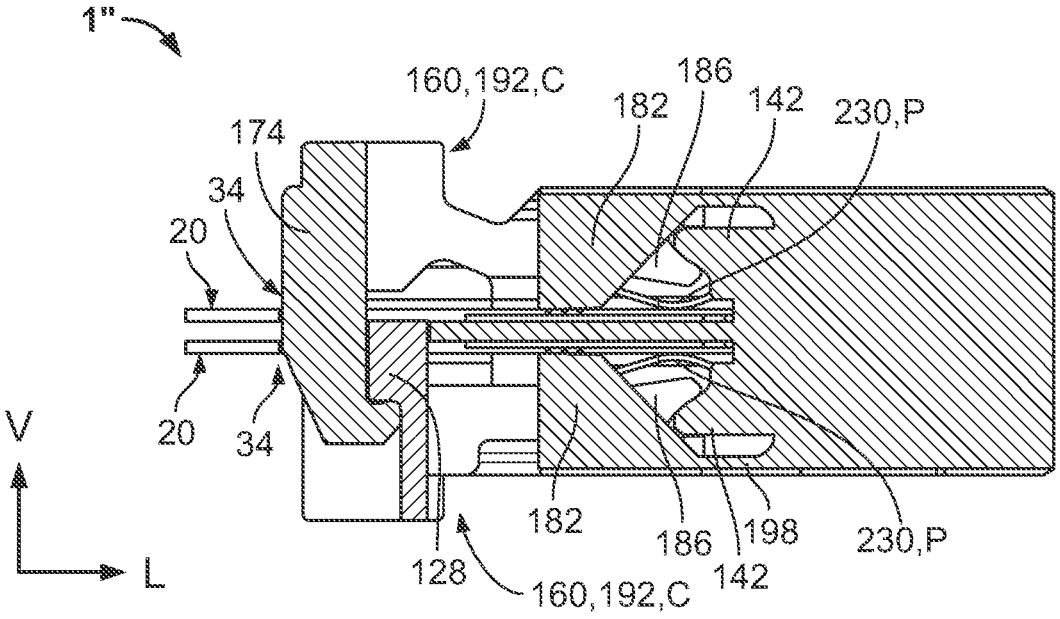
FIG. 21 is a sectional side view of the connector assembly of FIG. 18 with the first cover and the second cover in the closed position.

From the position shown in FIG. 20, with the second cover 194 held in the closed position C, the first cover 192 is rotated from the open position O into the closed position C with the first latch 174 extending through the first latch openings 34 of both FFCs 20, as shown in FIG. 21. The positioning of the first latch 174 in the first latch openings 34 of both FFCs 20 and the first catch 128 in the first latch opening 34 of one of the FFCs 20 allows for a keying of the FFCs 20, permitting positioning of each FFC 20 along one of the first side 152 and the second side 154 of the central wall 150.

As shown in FIG. 21, when the first cover 192 reaches the closed position C, the first latch 174 of the first cover 192 engages the first catch 128 of the second cover 194 to secure both the first cover 192 and the second cover 194 in the closed position C. In this position, the spring clips 200 on both sides 152, 154 of the central wall 150 are in the compressed position P and apply the forces on the conductors 40 as described above. The standoffs 182 of each of the first cover 192 and the second cover 194 abut the respective FFCs 20 and press the FFCs 20 toward the central wall 150 along the vertical direction V.

Figure 22:
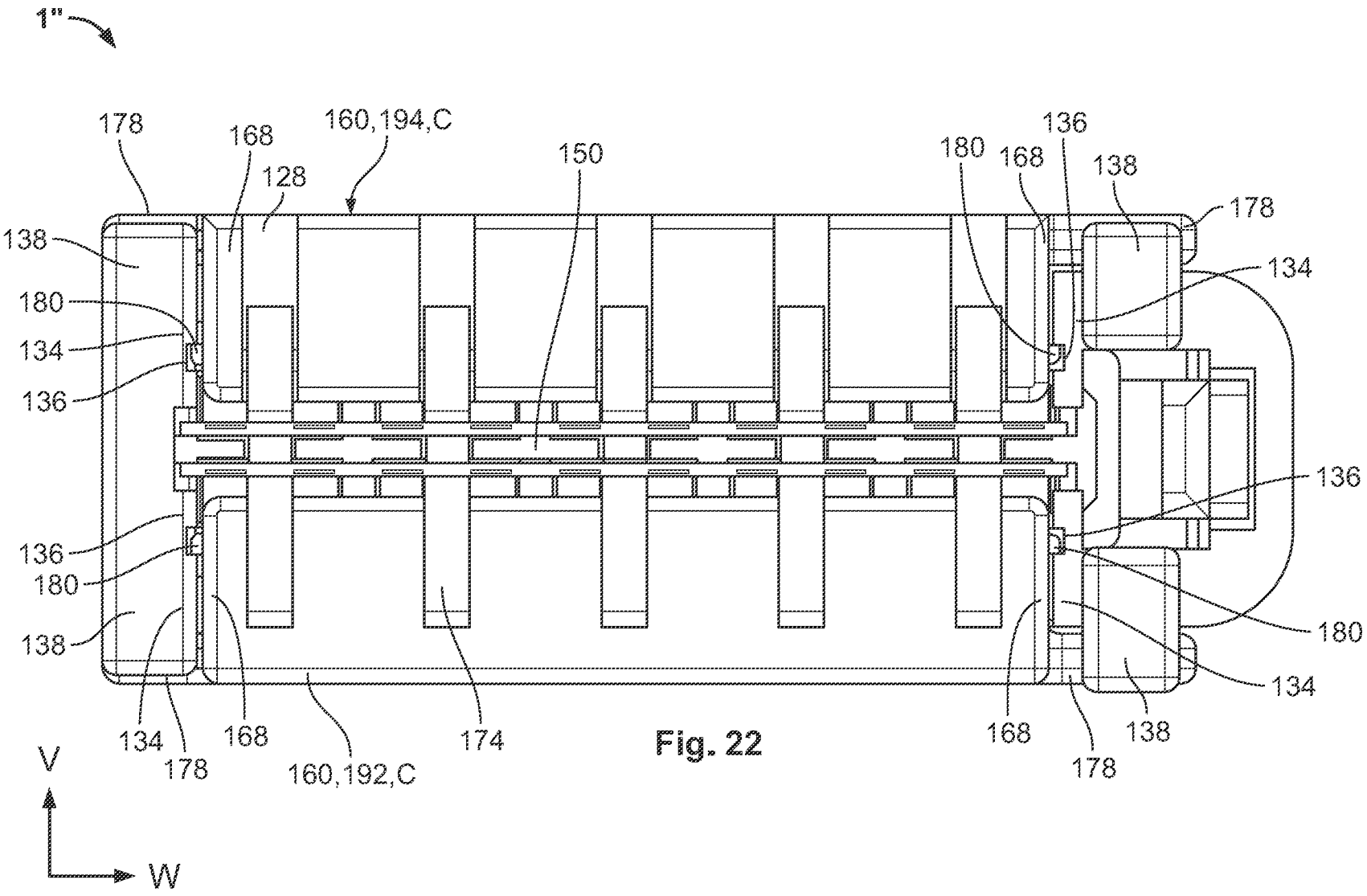
FIG. 22 is a front view of the connector assembly of FIG. 18 with the first cover and the second cover in the closed position.

As in the connector assemblies 1, 1', the first cover 192 and the second cover 194 in the connector assembly 1" are further secured in the closed positions C holding the second beams 230 in the compressed positions P by the engagement of the cover wedges 186 with the base wedges 142, as shown in FIG. 21, and the engagement of the protrusions 180 with the grooves 136, as shown in FIG. 22. The abutment of the flanges 178 with the positioning tabs 138, shown in FIG. 22, further limits movement of the first cover 192 and the second cover 194 out of the closed positions C along the longitudinal direction L. The connector assembly 1" allows securing of the second beams 230 in the compressed position P in a two row connector.

What is claimed is:

1. A spring clip, comprising:

a first beam; and a second beam connected to the first beam and resiliently deflectable toward the first beam from a relaxed position distal from the first beam to a compressed position proximal to the first beam, the second beam has a spring latch extending toward the first beam, the spring latch engages the first beam to secure the second beam in the compressed position, the second beam has a contact bend bent inwardly from the second beam toward the first beam and directly abutting a conductor between the first beam and the second beam.

2. The spring clip of claim 1, wherein the first beam has a first contact section, a second contact section, and a latch section between the first contact section and the second contact section along a longitudinal direction, the spring latch engages the first beam in the latch section.

3. The spring clip of claim 2, wherein the latch section is positioned above the first contact section and the second contact section in a vertical direction perpendicular to the longitudinal direction.

4. The spring clip of claim 2, wherein at least one of the first contact section and the second contact section has a textured pattern on a contact surface of the first beam facing the second beam.

5. The spring clip of claim 2, wherein the second beam has a contact bend extending toward the first beam and aligned with the first contact section.

6. The spring clip of claim 5, wherein the second beam has a friction lock aligned with the second contact section, the friction lock including a bent portion of the second beam bent back toward the first beam.

7. The spring clip of claim 6, wherein the spring latch engaging the first beam maintains a first contact force of the contact bend toward the first contact section and a second contact force of the friction lock toward the second contact section in the compressed position.

8. The spring clip of claim 1, wherein an embossment extends along the second beam and/or the first beam.

9. The spring clip of claim 1, wherein the spring latch has a sharp free end.

10. The spring clip of claim 1, wherein the first beam, the second beam, and the spring latch are monolithically formed in a single piece.

11. A connector for a flat flexible cable, comprising:

a housing having a base and a cover, the base has a closed section with a receiving passageway and an open section extending from the closed section, the cover is movable with respect to the base between an open position exposing the open section and a closed position in which the cover encloses the open section, the cover has a main body with a pressing surface and a first latch extending from the pressing surface, the first latch engaging a first catch of the housing in the closed position; and a spring clip disposed in the receiving passageway, the spring clip has a first beam and a second beam connected to the first beam, the pressing surface contacts the second beam as the cover moves from the open position to the closed position and deflects the second beam toward the first beam into a compressed position, the first latch engaging the first catch in the closed position secures the second beam in the compressed position.

12. The connector of claim 11, wherein the cover is attached to the base by a hinge and is rotatable about the hinge between the open position and the closed position.

13. The connector of claim 11, wherein the first catch is part of a bottom wall of the base.

14. The connector of claim 13, wherein the cover has a second latch extending from the pressing surface, the base has a latch passageway extending through the bottom wall to form a second catch in the bottom wall, the second latch engages the second catch in the closed position.

15. The connector of claim 11, wherein the base has a positioning tab extending from a sidewall of the base, the cover has a flange extending from the main body, the flange abuts the positioning tab in the closed position and limits movement of the cover with respect to the base along a longitudinal direction in which the spring clip is inserted into the receiving passageway.

16. The connector of claim 11, wherein the base has a groove extending in a sidewall of the base and the cover has a protrusion extending from a side surface of the main body, the protrusion engages the groove in a snap-fit in the closed position.

17. The connector of claim 11, wherein the cover has a standoff extending from the pressing surface and abutting the flat flexible cable or the base in the closed position.

18. The connector of claim 11, wherein the base has a base wedge extending from the closed section and the cover has a cover wedge extending from the pressing surface, the cover wedge abutting and moving along the base wedge as the cover moves between the open position and the closed position.

19. The connector of claim 18, wherein the main body of the cover has a latch beam disposed between the first latch and the cover wedge, the latch beam is resiliently flexible.

20. The connector of claim 11, wherein the cover has a retention peg extending from the pressing surface and the base has a retention arm extending from the open section, the retention peg is disposed in a retention recess of the retention arm in the closed position.

21. The connector of claim 11, wherein the base has a central wall and the cover is a first cover of the housing movable to enclose a first side of the central wall in the closed position, the housing has a second cover movable with respect to the base between an open position exposing a second side of the central wall and a closed position enclosing the second side.

22. The connector of claim 21, wherein the first catch is disposed on the second cover.

23. The connector of claim 22, wherein the base has a groove extending in a sidewall of the base and the second cover has a protrusion extending from a side surface, the protrusion engages the groove in a snap-fit in the closed position of the second cover.

24. A connector assembly, comprising:

a flat flexible cable having an insulation material and a plurality of conductors embedded in the insulation material, the plurality of conductors are exposed through a portion of the insulation material; and a connector including a housing and a spring clip disposed in the housing, the housing having a base and a cover movable with respect to the base between an open position and a closed position, the cover has a pressing surface and a latch extending from the pressing surface, the spring clip has a first beam and a second beam connected to the first beam, the flat flexible cable is disposed between the first beam and the second beam and one of the conductors is electrically connected to the spring clip, the pressing surface contacts the second beam as the cover moves from the open position to the closed position and deflects the second beam toward the first beam into a compressed position pressing the flat flexible cable between the first beam and the second beam, the first latch engages a first catch of the housing in the closed position to secure the second beam in the compressed position.

25. The connector assembly of claim 24, wherein the second beam has a spring latch extending toward the first beam, the spring latch engages the first beam to secure the second beam in the compressed position.

26. The connector assembly of claim 24, wherein the flat flexible cable has a latch opening extending through the insulation material, the latch extends through the insulation material in the closed position.

27. The connector assembly of claim 24, wherein the cover has a standoff extending from the pressing surface and positioned in a standoff opening extending through the insulation material in the closed position.

28. The connector assembly of claim 24, wherein the cover has a retention peg extending from the pressing surface and the base has a retention arm, the retention peg extends through a peg opening of the insulation material and is disposed in a retention recess of the retention arm in the closed position.

29. The connector assembly of claim 24, wherein the base has a window extending through a bottom wall of the base and through which the one of the conductors is welded to the spring clip.

30. A spring clip, comprising:

a first beam having a first contact section, a second contact section, and a latch section between the first contact section and the second contact section along a longitudinal direction, the latch section has an indent extending into the first beam in a width direction perpendicular to the longitudinal direction; and a second beam connected to the first beam and resiliently deflectable toward the first beam from a relaxed position distal from the first beam to a compressed position proximal to the first beam, the second beam has a spring latch extending toward the first beam, the spring latch engages the first beam in the latch section to secure the second beam in the compressed position, the spring latch is positioned in the indent when the spring latch engages the first beam.

* * * * *